US011471343B2

(12) United States Patent
Takahata et al.

(10) Patent No.: US 11,471,343 B2
(45) Date of Patent: Oct. 18, 2022

(54) TRAVELLING APPARATUS

(71) Applicants: Toyota Jidosha Kabushiki Kaisha, Toyota (JP); The University of Tokyo, Tokyo (JP)

(72) Inventors: Tomoyuki Takahata, Tokyo (JP); Yusuke Kosaka, Chofu (JP); Takashi Izuo, Toyota (JP)

(73) Assignees: TOYOTA JIDOSHA KABUSHIKI KAISHA, Toyota (JP); THE UNIVERSITY OF TOKYO, Tokyo (JP)

( * ) Notice: Subject to any disclaimer, the term of this patent is extended or adjusted under 35 U.S.C. 154(b) by 284 days.

(21) Appl. No.: 16/838,305

(22) Filed: Apr. 2, 2020

(65) Prior Publication Data

US 2020/0315879 A1 Oct. 8, 2020

(30) Foreign Application Priority Data

Apr. 5, 2019 (JP) ..... JP2019-073065

(51) Int. Cl.
*A61G 5/06* (2006.01)
*A61G 5/04* (2013.01)

(52) U.S. Cl.
CPC ..... *A61G 5/065* (2013.01); *A61G 5/046* (2013.01); *A61G 5/061* (2013.01)

(58) Field of Classification Search
CPC ..... A61G 5/065; A61G 5/061; A61G 5/046; A61G 5/06
USPC ..... 280/124.12
See application file for complete search history.

(56) References Cited

U.S. PATENT DOCUMENTS

| | | | | |
|---|---|---|---|---|
| 3,638,745 | A * | 2/1972 | Floyd | A61G 5/061 60/466 |
| 6,062,600 | A * | 5/2000 | Kamen | A61G 5/04 280/755 |
| 6,341,784 | B1 * | 1/2002 | Carstens | A61G 5/061 280/5.32 |
| 10,137,042 | B2 * | 11/2018 | Ishikawa | A61G 5/04 |
| 10,802,495 | B2 * | 10/2020 | Peret | G05D 1/0246 |
| 10,905,607 | B2 * | 2/2021 | Moore | A61G 5/041 |
| 2015/0374564 | A1 * | 12/2015 | Sutton | A61G 5/128 280/657 |
| 2017/0172823 | A1 | 6/2017 | Ishikawa et al. | |

FOREIGN PATENT DOCUMENTS

| | | | |
|---|---|---|---|
| CN | 1225004 | A | 8/1999 |
| CN | 106572935 | A | 4/2017 |
| JP | 2000-514680 | A | 11/2000 |
| JP | 2008-128393 | A | 6/2008 |

(Continued)

*Primary Examiner* — James A Shriver, II
*Assistant Examiner* — Hilary L Johns
(74) *Attorney, Agent, or Firm* — Dinsmore & Shohl LLP

(57) ABSTRACT

A travelling apparatus having a high travelling performance with a simple structure is provided. A travelling apparatus according to an embodiment includes: a frame; front wheels disposed in a front of the frame; first links configured to be extendable and retractable and coupled between the front wheels and an oscillation axis located in a rear of the front wheels; and first linear motion mechanisms that are coupled between the frame and the first links and are extended and retracted so as to rotate the first links about the oscillation axis.

6 Claims, 17 Drawing Sheets

(56) References Cited

FOREIGN PATENT DOCUMENTS

| | | | |
|---|---|---|---|
| JP | 2013-52858 | A | 3/2013 |
| JP | 2013-208246 | A | 10/2013 |
| JP | 2016-511666 | A | 4/2016 |
| WO | 98/02122 | A1 | 1/1998 |
| WO | 2016006248 | A1 | 1/2016 |

* cited by examiner

TRAVELLING APPARATUS

CROSS REFERENCE TO RELATED APPLICATIONS

This application is based upon and claims the benefit of priority from Japanese patent application No. 2019-073065, filed on Apr. 5, 2019, the disclosure of which is incorporated herein in its entirety by reference.

BACKGROUND

The present disclosure relates to a travelling apparatus.

International Patent Publication No. WO 2016/006248 discloses a travelling apparatus that can ascend and descend stairs. The travelling apparatus disclosed in this document includes six wheels. Right and left front wheels are driving wheels. Two wheels are arranged on one side of the travelling apparatus behind the right and left front wheels. Further, a first linear motion mechanism that couples together a vehicle body and front wheels are extended and retracted. A second linear motion mechanism that couples together the vehicle body and middle wheels is extended and retracted.

The middle wheels and rear wheels are coupled together by a first link, and the first link and the vehicle body are coupled together by a second link. The travelling apparatus further includes an actuator configured to change an angle between the vehicle body and the second link. Since the first linear motion mechanism, the second linear motion mechanism, and the actuator operate, the travelling apparatus is able to climb up or go down stairs.

SUMMARY

It has been required in the above travelling apparatus to further improve performance. It has been required, for example, to improve travelling performance in such a way that the travelling apparatus can climb up or go down higher steps. It has also been required to further simplify the structure of the apparatus in order to reduce the size and the weight thereof.

The present disclosure has been made in view of the aforementioned circumstances and provides a travelling apparatus having a high travelling performance with a simple structure.

A travelling apparatus according to this embodiment includes: a vehicle body; a first wheel configured to be disposed in a front of the vehicle body; a first link configured to be extendable and retractable and coupled between the first wheel and an oscillation axis located in a rear of the first wheel; and a first linear motion mechanism that is coupled between the vehicle body and the first link and is extended and retracted so as to rotate the first link about the oscillation axis. According to the aforementioned structure, it is possible to achieve a high travelling performance with a simple structure.

The aforementioned travelling apparatus may further include: a first brake configured to restrict rotation of the first link about the oscillation axis; a second brake configured to restrict the extension and retraction of the first link; a second wheel configured to be disposed in a rear of the first wheel; and a driving mechanism configured to raise and lower the second wheel. According to this structure, the first link can be appropriately controlled, whereby the travelling apparatus is able to definitely climb up or go down steps.

The aforementioned travelling apparatus may further include: a third wheel configured to be disposed in a rear of the second wheel; and a second link configured to couple together the second wheel and the third wheel, in which the driving mechanism may be a second linear motion mechanism that is coupled between the second link and the vehicle body and rotates the second link. The second linear motion mechanism is able to raise and lower the second and third wheels.

In the aforementioned travelling apparatus, at least two of the first to third wheels may be driving wheels. According to this structure, it is possible to achieve a high travelling performance with a simple structure.

In the aforementioned travelling apparatus, a dilatant fluid may be included in at least one of the second and third wheels. According to this structure, it is possible to achieve a high travelling performance with a simple structure.

In the aforementioned travelling apparatus, the first wheel, the second wheel, the third wheel, the first linear motion mechanism, and a second linear motion mechanism may be arranged on right and left sides of the travelling apparatus and may be driven independently on the right and left sides of the travelling apparatus. It is therefore possible to improve the travelling performance.

The aforementioned travelling apparatus may further include a wheel brake configured to restrict rotation of the first wheel. Since it is possible to prevent the wheel from sliding when the travelling apparatus climbs up or goes down steps, the travelling performance can be improved.

A travelling apparatus according to another aspect of this embodiment includes: a vehicle body; a first wheel configured to be disposed in a front of the vehicle body; a first driving mechanism configured to raise and lower the first wheel; a second wheel configured to be disposed in a rear of the first wheel; and a third wheel configured to be disposed in a rear of the second wheel, in which at least two of the first to third wheels are driving wheels. According to this structure, it is possible to achieve a high travelling performance with a simple structure.

The aforementioned travelling apparatus may further include: an in-wheel motor provided in one of the second and third wheels; and a transmission mechanism configured to transmit a driving force of the in-wheel motor to the other one of the second and third wheels. According to this structure, it is possible to achieve a high travelling performance with a simple structure.

A travelling apparatus according to another aspect of this embodiment is a travelling apparatus capable of climbing up and going down a step, the travelling apparatus including: a vehicle body; and a wheel having a dilatant fluid included therein. According to this structure, it is possible to achieve a high travelling performance with a simple structure.

The aforementioned travelling apparatus may further include: a first wheel; a second wheel configured to be disposed in a rear of the first wheel; a third wheel configured to be disposed in a rear of the second wheel; and a driving mechanism configured to move the first wheel upward or downward, in which at least one of the second wheel and the third wheel may be a wheel having the dilatant fluid included therein. According to this structure, the travelling apparatus is able to easily climb up or go down steps.

According to the present disclosure, it is possible to provide a travelling apparatus having a high travelling performance with a simple structure.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Hereinafter, specific embodiments to which the present disclosure is applied will be described in detail with reference to the drawings. However, the present disclosure is not limited to the following embodiments. Further, the following descriptions and drawings are simplified as appropriate for clarity of the descriptions.

First Embodiment

Overall Structure

Figure 1:
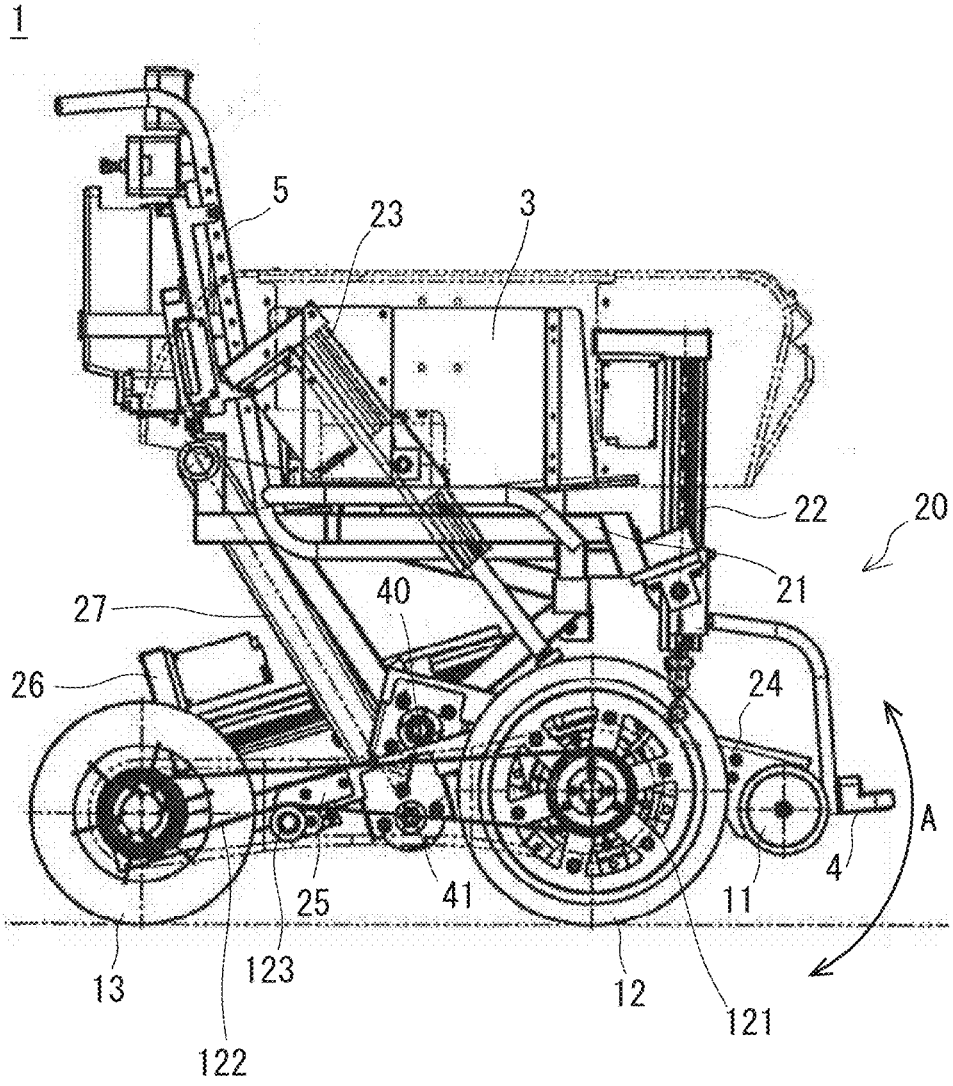
FIG. 1 is a side view showing a structure of a vehicle according to an embodiment.
Figure 1:
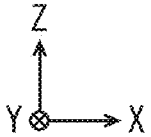
Figure 2:
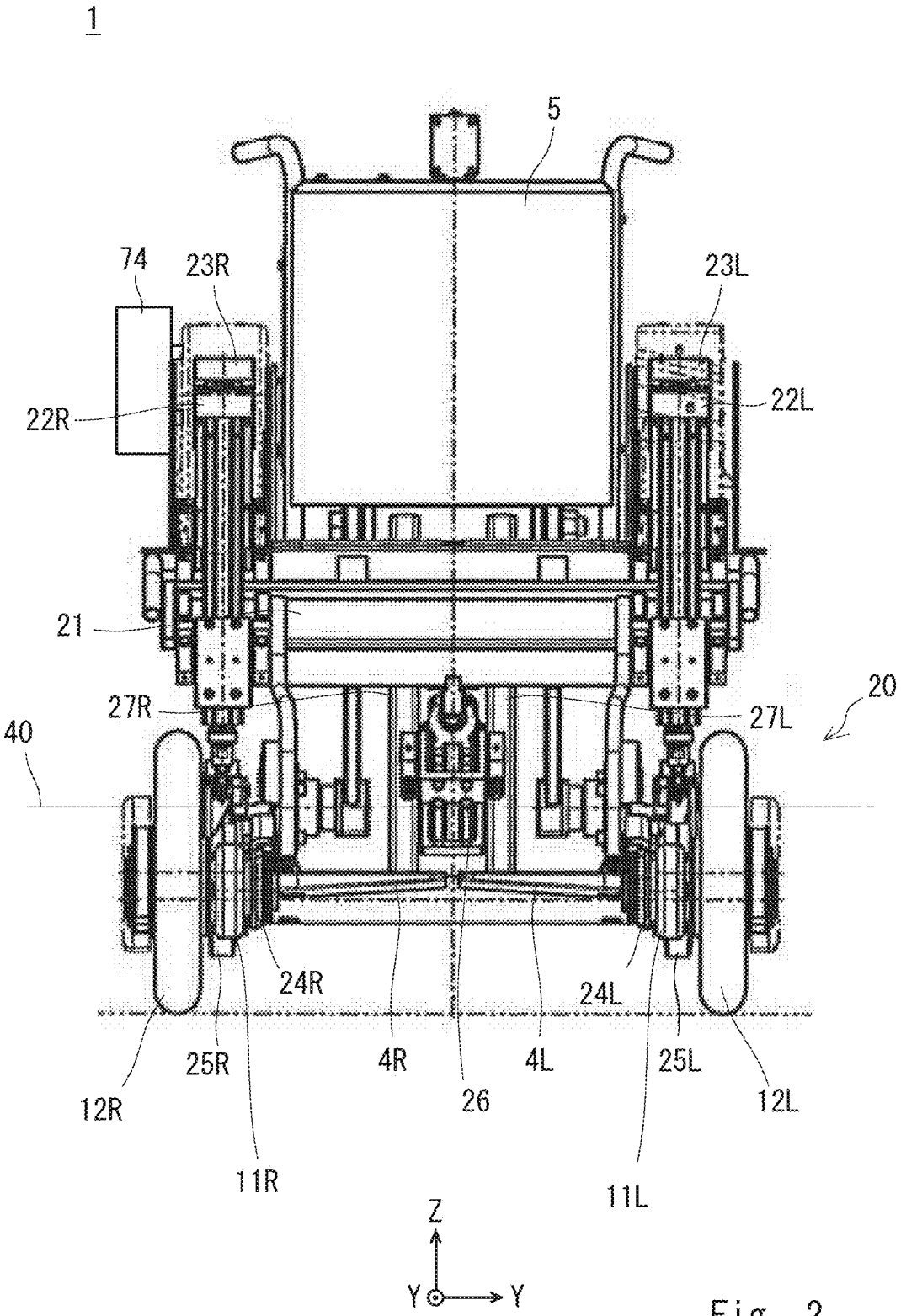
FIG. 2 is a front view showing a structure of the vehicle according to this embodiment.
Figure 3:
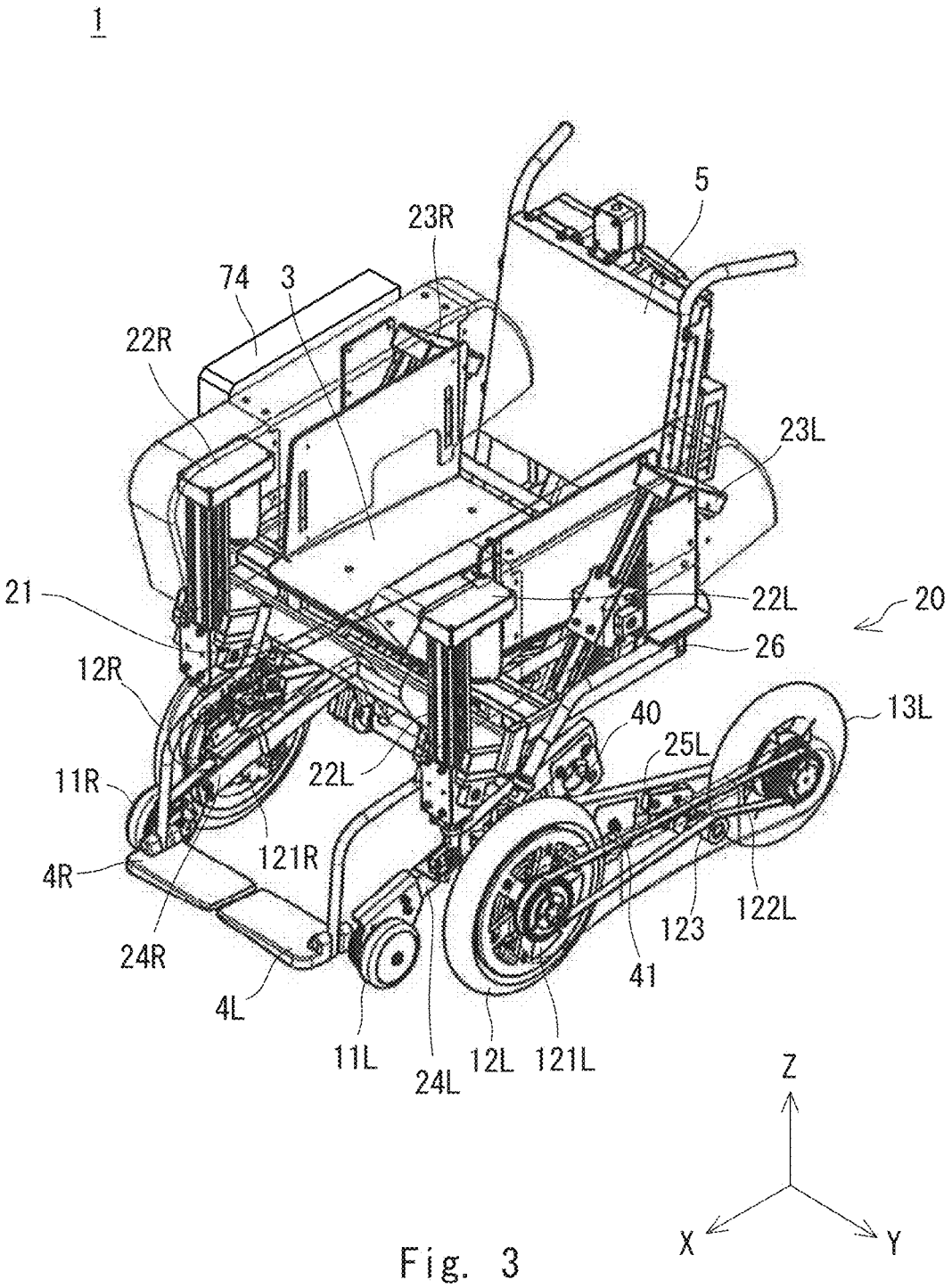
FIG. 3 is a perspective view showing a structure of the vehicle according to this embodiment.

A vehicle, which is an example of a travelling apparatus according to this embodiment, will be described by referring to FIGS. 1 to 3. FIG. 1 is a side view showing a structure of a vehicle 1, and FIG. 2 is a front view thereof. FIG. 3 is a perspective view showing the structure of the vehicle 1, and FIG. 4 is a cross-sectional side view thereof.

An XYZ Cartesian coordinate system is used for the description of FIGS. 1 to 4. The +X direction is a front of the vehicle 1, and the −X direction is a back of the vehicle 1. Further, the +Y direction is a left direction of the vehicle 1, and the −Y direction is a right direction of the vehicle 1. The +Z direction is vertically upward, and the −Z direction is vertically downward.

The vehicle 1 includes a riding seat 3, footrests 4, a backrest 5, an input unit 74, front wheels 11, middle wheels 12, rear wheels 13, and a variable mechanism 20. Note that the main part of the vehicle 1 has a bilaterally symmetric structure and includes the footrests 4, the front wheels 11, the middle wheels 12, and the rear wheels 13 on both sides of the vehicle 1.

Figure 4:
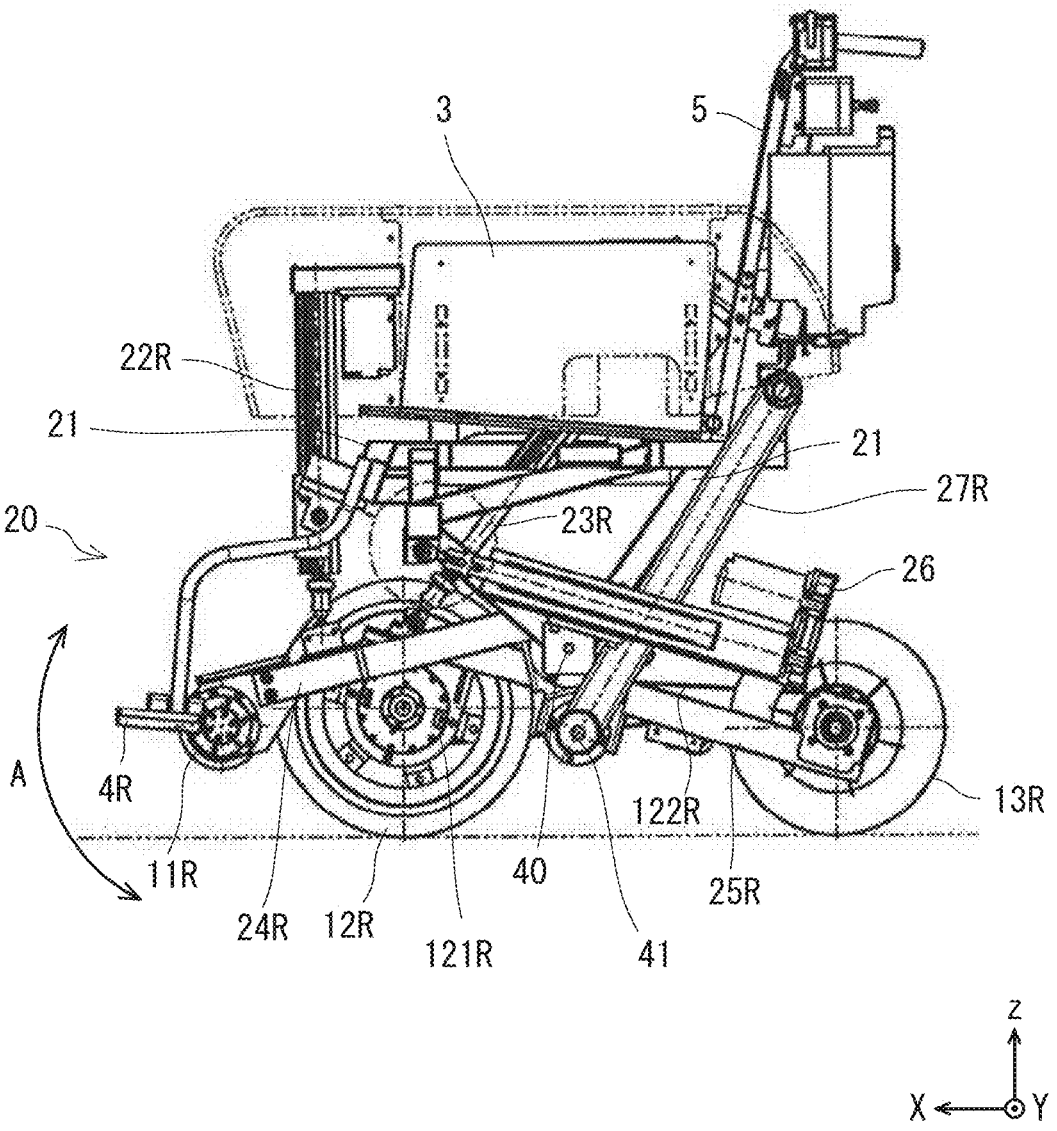
FIG. 4 is a cross-sectional side view showing a structure of the vehicle according to this embodiment.

Accordingly, in FIGS. 2 to 4, the footrest 4, the front wheel 11, the middle wheel 12, and the rear wheel 13 arranged on the left side (on the +Y side) of the vehicle 1 are denoted as a footrest 4L, a front wheel 11L, a middle wheel 12L, and a rear wheel 13L, respectively. Likewise, in FIGS. 2 to 4, the footrest 4, the front wheel 11, and the middle wheel 12 arranged on the right side (on the −Y side) of the vehicle 1 are denoted as a footrest 4R, a front wheel 11R, and a middle wheel 12R, respectively. In FIGS. 2 and 3, the rear wheel 13R and the rear wheel 13L are symmetrically arranged, although the rear wheel 13R is hidden behind other components. In the following descriptions, if there is no clear distinction between the right and left structures, the components will be described without using L and R. The variable mechanism 20 also has a symmetric structure.

The middle wheels 12 are arranged between the front wheels 11 and the rear wheels 13 in the X direction. That is, the front wheels 11 are arranged on the front side (on the +X side) of the middle wheels 12 and the rear wheels 13, and the rear wheels 13 are arranged on the rear side (on the −X side) of the middle wheels 12 and the front wheels 11. In the XZ plane, the axle of the front wheel 11L and that of the front wheel 11R are in the same position. In the XZ plane, the axle of the middle wheel 12L and that of the middle wheel 12R are in the same position, and the axle of the rear wheel 13L and that of the rear wheel 13R are in the same position.

The middle wheels 12 and the rear wheels 13, which are driving wheels, are rotated when motors or the like are driven. The middle wheel 12L and the middle wheel 12R, which are connected to motors different from each other, are rotated independently from each other. For example, a motor 121R is connected to the middle wheel 12R and a motor 121L is connected to the middle wheel 12L. That is, the motor 121R rotationally drives the middle wheel 12R. The motor 121L rotationally drives the middle wheel 12L. The motors 121R and 121L are in-wheel motors respectively provided in the middle wheels 12R and 12L.

Further, the driving force of the motor 121L is transmitted to the rear wheel 13L via a transmission mechanism 122L. The transmission mechanism 122L includes a belt, a chain or the like. Further, the transmission mechanism 122L may include a pulley for stretching and extending the belt or the like. The driving force of the motor 121L is transmitted to the rear wheel 13L. Accordingly, the middle wheel 12L and the rear wheel 13L are rotated by one motor 121L about axles separated from each other in the front-back direction. The middle wheel 12L and the rear wheel 13L are rotated in the same direction. Further, in a similar way, the driving force of the motor 121R of the middle wheel 12R is also transmitted to the rear wheel 13R via a transmission mechanism 122R. Further, the rear wheels 13L and 13R are omni-directional wheels.

Further, as shown in FIG. 1, a tensioner 123 that gives a tensile force (tension) to the belt which serves as the transmission mechanism 122 is disposed in each of the second links 25. In some embodiments, the tensioner 123 is disposed below the belt of the transmission mechanism 122. According to the above structure, it is possible to prevent the belt from being brought into contact with a step when the vehicle 1 climbs up or goes down the step. Further, the transmission mechanism 122 may be covered with a cover or the like.

The front wheels 11, which are trailing wheels, are rotated according to a movement of the vehicle 1. More specifically, when the middle wheels 12 and the rear wheels 13 are driven and the vehicle 1 is moved, the front wheels 11 are rotated following the movement of the vehicle 1. In this way, the vehicle 1 is a four-wheel drive six-wheeled vehicle.

According to the above structure, it is possible to improve the travelling performance. Even when there is a gap in front of a step, for example, since the middle wheels 12 or the rear wheels 13 are driven, the vehicle 1 can come closer to the step. That is, even when the front wheels 11 are not grounded, it is possible to ensure a driving force to enable the vehicle 1 to travel forward. Accordingly, even in a case in which there is a gap in front of a step, the front wheels 11 can get over the gap. The first linear motion mechanisms 22 can raise and lower the front wheels 11 in a state in which the front wheels 11 come closer to the step. Since the front wheels 11 can be lowered to an appropriate position on the step, the vehicle 1 can be adapted to steps of various shapes. Further, even when the middle wheels 12 or the rear wheels 13 are not grounded, it is possible to ensure the driving force to enable the vehicle 1 to travel forward.

When, for example, the vehicle 1 is moved straight forward, the motor 121L and the motor 121R are rotated in the same rotation direction at the same rotation speed. When the vehicle 1 is moved while turning to the right and left, the motor 121L and the motor 121R are rotated in the same rotation direction at rotation speeds different from each other. In order to revolve the vehicle on the spot, the motor 121L and the motor 121R are rotated in opposite directions at the same rotation speed. As described above, when the left middle wheel 12L and the right middle wheel 12R are driven by motors different from each other, the vehicle 1 is moved in a desired direction at a desired speed.

The middle wheels 12 have a diameter larger than those of the front wheels 11 and the rear wheels 13. The front wheels 11 have a diameter smaller than that of the rear wheels 13. As a matter of course, the diameters of the front wheels 11, the middle wheels 12, and the rear wheels 13 are not particularly limited. The front wheels 11 and the middle wheels 12 are each provided with a brake for restricting rotation. The front wheel 11L, the front wheel 11R, the middle wheel 12L, and the middle wheel 12R are each provided, for example, with an electromagnetic brake. Therefore, each of the brakes is able to independently lock the front wheel 11L, the front wheel 11R, the middle wheel 12L, and the middle wheel 12R.

The in-wheel motors are used as the motors 121, and the transmission mechanisms 122 transmit the driving forces of the motors 121 to the rear wheels 13. It is therefore possible to cause the middle wheels 12 and the rear wheels 13 to be used as the driving wheels with a simple structure. Therefore, even in a state in which the middle wheels 12 or the rear wheels 13 are off the ground, the vehicle 1 is able to obtain a forward driving force.

While the motors 121 are described as the in-wheel motors provided in the middle wheels 12 in FIGS. 1-4, the structure of the motors 121 is not limited thereto. The motors 121 may be in-wheel motors provided in the rear wheels 13. In this case, the transmission mechanisms may transmit the driving forces of the motors 121 to the rear wheels 13. Alternatively, the motors 121 may be motors other than the in-wheel motors.

The riding seat 3 is a riding part for an occupant to ride on. The vehicle 1 is moved in a state in which the occupant is sitting on the riding seat 3. The backrest 5 and the footrests 4 are provided in the riding seat 3. The footrests 4 are arranged at a lower front side of the riding seat 3. In the state in which the occupant is sitting on the riding seat 3, a right foot of the occupant is placed on the footrest 4R, and a left foot of the occupant is placed on the footrest 4L.

The input unit 74 is provided next to the riding seat 3. The input unit 74 is a keyboard, a joypad or the like and receives inputs regarding a movement direction and a posture of the vehicle 1. For example, the occupant operates the input unit 74 to input the movement direction, the movement speed, or the posture. A control box including a computer for control, which will be a controller, a battery and the like may be provided in the input unit 74, although it is not shown in the drawings. As a matter of course, the place where the computer for control, the battery and the like are located is not limited inside the input unit 74. The computer for control, the battery and the like may be installed, for example, under the riding seat 3 or behind the backrest 5.

The variable mechanism 20 is provided under the riding seat 3. The variable mechanism 20 is a leg mechanism that supports the riding seat 3. The front wheels 11, the middle wheels 12, and the rear wheels 13 are rotatably attached to the variable mechanism 20. The variable mechanism 20, which includes extendable and retractable arm mechanisms, changes a posture of the riding seat 3 with respect to the ground. The arm mechanism provided between the wheels and the riding seat 3 is extended and retracted, which causes a height and a slope of the seating surface of the riding seat 3 to be changed.

Variable Mechanism 20

The detailed structure of the variable mechanism 20 will be explained. The variable mechanism 20 includes a frame 21, first linear motion mechanisms 22, second linear motion mechanisms 23, first links 24, second links 25, a third linear motion mechanism 26, third links 27 and the like. The variable mechanism 20 has a substantially symmetric structure. In a manner similar to the above described one, each of the symmetric components is denoted with a symbol of L or R. The variable mechanism 20 includes, for example, two first linear motion mechanisms 22L and 22R. The first linear motion mechanism 22L and the first linear motion mechanism 22R are symmetrically arranged.

In a similar way, the second linear motion mechanisms 23, the first links 24, the second links 25, and the third links 27 are also symmetrically arranged. In FIGS. 2-4, each of the bilaterally symmetric components is denoted with a symbol of L or R.

The frame 21 constitutes a vehicle body of the vehicle 1. Therefore, the above-mentioned riding seat 3, the footrests 4, the input unit 74 and the like are attached to the frame 21. The riding seat 3 is attached, for example, above the frame 21. The footrests 4 are attached obliquely forward and downward of the frame 21.

When the riding seat 3 is attached above the frame 21, the riding part is formed. Accordingly, a posture of the frame 21 corresponds to a posture of the riding seat 3. When the height of the frame 21 is changed, the height of the riding seat 3 is changed, while when an angle of the frame 21 is changed, an angle of the riding seat 3 is changed. When the frame 21 is tilted forward, the riding seat 3 is also tilted forward. The frame 21 has a rectangular frame shape. Further, the frame 21 rotatably supports the riding seat 3. As will be described later, the forward-inclining posture of the riding seat 3 can be adjusted by the operation of the third linear motion mechanism 26.

The first linear motion mechanisms 22L and 22R are attached to the right and left ends of the front side of the frame 21. The first links 24L and 24R are respectively attached to the first linear motion mechanisms 22L and 22R. As described above, since the first linear motion mechanisms 22L and 22R and the first links 24L and 24 have symmetric structures, each of these components will be described without adding L or R thereto in the following descriptions. The first linear motion mechanisms 22 and the first links 24 compose arm mechanisms, which serve as front legs.

The first linear motion mechanisms 22 are attached to the frame 21. For example, the first linear motion mechanisms 22 are arranged in the front ends of the frame 21. The first linear motion mechanisms 22 are rotatably held in the frame 21. The first linear motion mechanisms 22 are attached to the frame 21 via, for example, trunnion or the like. The first linear motion mechanisms 22 are extended obliquely forward and downward from the frame 21. The ends of the first linear motion mechanisms 22 are attached to the first links 24. The first linear motion mechanisms 22 couple together the frame 21 and the first links 24. The first linear motion mechanisms 22 are, for example, extendable and retractable arm mechanisms, and operate by an actuator such as a motor. The length of the first linear motion mechanisms 22 is variable.

The front wheels 11 are attached to the front ends of the first links 24. That is, the first links 24 rotatably hold the front wheels 11. The front wheels 11 are disposed in a front of the frame 21, which serves as a vehicle body. Here, the expression "the front of the frame 21" may indicate a part which is in front of the frame 21 or a part in the vicinity of the front end of the frame 21.

The first links 24 are extended obliquely backward and upward from the front wheels 11. An oscillation axis 40 is provided in rear ends of the first links 24. That is, the first links 24 couple together the front wheels 11 and the oscillation axis 40. The first links 24 are coupled to the frame 21 via the oscillation axis 40. Since the first links 24 are coupled to the frame 21 via the oscillation axis 40, they are rotated about the oscillation axis 40. That is, the frame 21 rotatably holds the first links 24 via the oscillation axis 40. As shown in FIG. 2, the oscillation axis 40 is arranged to be parallel to the Y direction.

The first linear motion mechanisms 22 are attached to a middle part of the first links 24. In the longitudinal direction of the first links 24, the first linear motion mechanisms 22 are attached to a part of the first links 24 that is close to the front wheels 11 with respect to the center of the first links 24. The first linear motion mechanisms 22 are extended and retracted, whereby the first links 24 are rotated about the oscillation axis 40 (arrow A in FIGS. 1 and 4). Specifically, the first linear motion mechanisms 22 are extended, whereby the first links 24 are rotated in a clockwise direction in FIG. 1. That is, the first linear motion mechanisms 22 are extended, which causes the first links 24 to be further inclined forward. Further, the first linear motion mechanisms 22 are retracted, which causes the first links 24 to be rotated in a counterclockwise direction in FIG. 1.

As described above, the first linear motion mechanisms 22 are operated, which causes the angle of the first links 24 with respect to the frame 21 to be changed. The relative positions of the front wheels 11 with respect to the frame 21 are changed in the X and Z directions. The first linear motion mechanisms 22 are extended, whereby the front wheels 11 are lowered. The first linear motion mechanisms 22 are retracted, whereby the front wheels 11 are raised. The first linear motion mechanisms 22 raise or lower the front wheels 11 in such a way that the front wheels 11 are off the ground or grounded. The front wheels 11 are able to get over a step. Further, the first links 24 are extendable and retractable arm mechanisms. The details of the first links 24 will be explained later.

The second linear motion mechanisms 23L and 23R are attached to the right and left ends on the rear side of the frame 21. The second links 25L and 25R are respectively attached to the second linear motion mechanisms 23L and 23R. The second links 25L and 25R are attached to the frame 21 via the third links 27L and 27R, respectively. Since the second linear motion mechanisms 23L and 23R, the second links 25L and 25, and the third links 27L and 27R have symmetric structures, each of these components will be described without adding L or R thereto in the following descriptions. The second linear motion mechanisms 23L and 23R, the second links 25L and 25, and the third links 27L and 27R compose arm mechanisms, which serve as rear legs.

The second linear motion mechanisms 23 are attached to the frame 21. The second linear motion mechanisms 23 are rotatably held in the frame 21. The second linear motion mechanisms 23 are attached to, for example, the frame 21 via trunnion or the like. The second linear motion mechanisms 23 are extended obliquely downward from the frame 21. The second links 25 are attached to the ends of the second linear motion mechanisms 23. The second linear motion mechanisms 23 couple together the frame 21 and the second links 25. The second linear motion mechanisms 23, which are, for example, extendable and retractable arm mechanisms, are operated by an actuator such as a motor. The length of the second linear motion mechanisms 23 is variable.

The middle wheels 12 are attached to the front ends of the second links 25. The rear wheels 13 are attached to the rear ends of the second links 25. The second links 25 couple together the middle wheels 12 and the rear wheels 13. Therefore, in the X direction, the middle wheels 12 and the rear wheels 13 are arranged in such a way that they are separated from each other. The second linear motion mechanisms 23 are coupled to the second links 25 in the vicinity of the middle wheels 12.

The third links 27 are coupled to a middle part of the second links 25. As shown in FIG. 1, the third links 27 are extended obliquely forward and downward from the frame 21. The frame 21 is coupled to the upper ends of the third links 27 and the second links 25 are rotatably coupled to the lower ends of the third links 27. The third links 27 are coupled to the second links 25 via a rotation axis 41. That is, the third links 27 rotatably hold the second links 25. The second links 25 are rotated about the rotation axis 41. The rotation axis 41 is arranged to be parallel to the Y direction. The rotation axis 41 is provided between the middle wheels 12 and the rear wheels 13. The rotation axis 41 is located on a side of the rear wheels 13 with respect to the position in which the second linear motion mechanisms 23 are coupled to the second links 25.

The second linear motion mechanisms 23 are extended and retracted, which causes the second links 25 to be rotated about the rotation axis 41. The second linear motion mechanisms 23 are retracted, whereby the second links 25 are rotated in a counterclockwise direction in FIG. 1. For example, the second linear motion mechanisms 23 are retracted, whereby the second links 25 are rotated in the direction in which the middle wheels 12 are relatively raised with respect to the rear wheels 13. The second linear motion mechanisms 23 are extended, whereby the second links 25 are rotated in a clockwise direction in FIG. 1. For example, the second linear motion mechanisms 23 are extended, whereby the second links 25 are rotated in the direction in which the middle wheels 12 are relatively lowered with respect to the rear wheels 13. Therefore, the angle of the second links 25 with respect to the frame 21 is changed. In the X and Z directions, the relative positions of the middle wheels 12 and the rear wheels 13 with respect to the frame 21 are changed. The second linear motion mechanisms 23 are able to raise or lower the middle wheels 12 and the rear wheels 13 in such a way that the middle wheels 12 and the rear wheels 13 are off the ground or grounded. The middle wheels 12 and the rear wheels 13 are able to get over the steps.

The third linear motion mechanism 26 is shared by the right and left parts of the vehicle 1. That is, unlike the first linear motion mechanisms 22, the second linear motion mechanisms 23 and the like, the third linear motion mechanism 26 is not provided on each of the right and left sides. As shown in FIG. 2, one third linear motion mechanism 26 is provided in the central part of the vehicle 1 in the Y direction.

The third linear motion mechanism 26 is attached to the third links 27L and 27R. The third linear motion mechanism 26 is rotatably held in the third links 27. For example, the third linear motion mechanism 26 is attached to the third links 27 via trunnion or the like. The end of the third linear motion mechanism 26 is attached to the riding seat 3. The third linear motion mechanism 26 couples together the riding seat 3 and the third links 27. The third linear motion mechanism 26, which is, for example, an extendable and retractable arm mechanism, is operated by an actuator such as a motor. The length of the third linear motion mechanism 26 is variable. Since the third linear motion mechanism 26 is extended and retracted, the angle of the riding seat 3 with respect to the frame 21 is changed. Accordingly, the forward-inclining posture of the riding seat 3 can be adjusted. Accordingly, when the vehicle 1 climbs up or goes down a step, a change in the angle of the riding seat 3 can be prevented, thereby improving ride quality.

As described above, the variable mechanism 20 includes the first linear motion mechanisms 22R and 22L, the second linear motion mechanisms 23R and 23L, and the third linear motion mechanism 26. In summary, the variable mechanism 20 is composed of five-axis linear motion joints. That is, the posture of the vehicle 1 can be changed by five actuators. The first linear motion mechanisms 22 rotationally oscillate the first links 24, which are the front legs, and the second linear motion mechanisms 23 rotationally oscillate the second links 25, which are the rear legs.

The first linear motion mechanisms 22, the second linear motion mechanisms 23, and the third linear motion mechanism 26 are extendable and retractable link mechanisms. Each of the linear motion mechanisms 22, 23, and 26 includes a driving unit including a motor, a brake, and an encoder, and a link that is extended and retracted by the driving unit. Note that known linear actuators may be used for the linear motion mechanisms. For example, the linear motion mechanism converts a force of a servomotor in the rotation direction into a force in an extending and retracting direction by a ball screw. When a lead of the ball screw is made small, only a small force is required to achieve a large force in a straight direction. In this manner, the linear motion mechanisms will not be pushed by a weight of the occupant to cause the linear motion mechanisms to be retracted, thereby enabling the variable mechanism 20 to maintain its posture. As the linear actuators are used in this embodiment, the structure of the vehicle 1 can be simplified.

Further, when gas springs are used together with the linear actuators for the linear motion mechanisms, it is possible to reduce loads on the motors. Furthermore, the linear motion mechanisms are not limited to motorized actuators and may instead be hydraulic or pneumatic linear actuators.

The linear motion of the first linear motion mechanisms 22 enables the first links 24 to be rotationally oscillated. It is therefore possible for the travelling apparatus to be adapted to various types of steps. It is possible, for example, to raise the front wheels 11 onto a step higher than the linear motion possible distance (stroke) of the first linear motion mechanisms 22. That is, the first linear motion mechanisms 22 having a short stroke can be used, whereby it is possible to prevent the first linear motion mechanisms 22 from interfering with a space for the occupant to ride. That is, an amount of protrusion on the upper side of the first linear motion mechanisms 22 can be made small, whereby it is possible to ensure the riding space. The first linear motion mechanisms 22 oscillate and rotate the first links 24, which raises and lowers the front wheels 11. As described above, the amount of the vertical movement of the front wheels 11 can be made larger than the stroke of the first linear motion mechanisms 22. It is therefore possible for the travelling apparatus to be adapted to a higher step than the stroke of the first linear motion mechanisms 22. It is therefore possible to provide the travelling apparatus having a high travelling performance with a simple structure.

Operations of First Links 24

Figure 5:
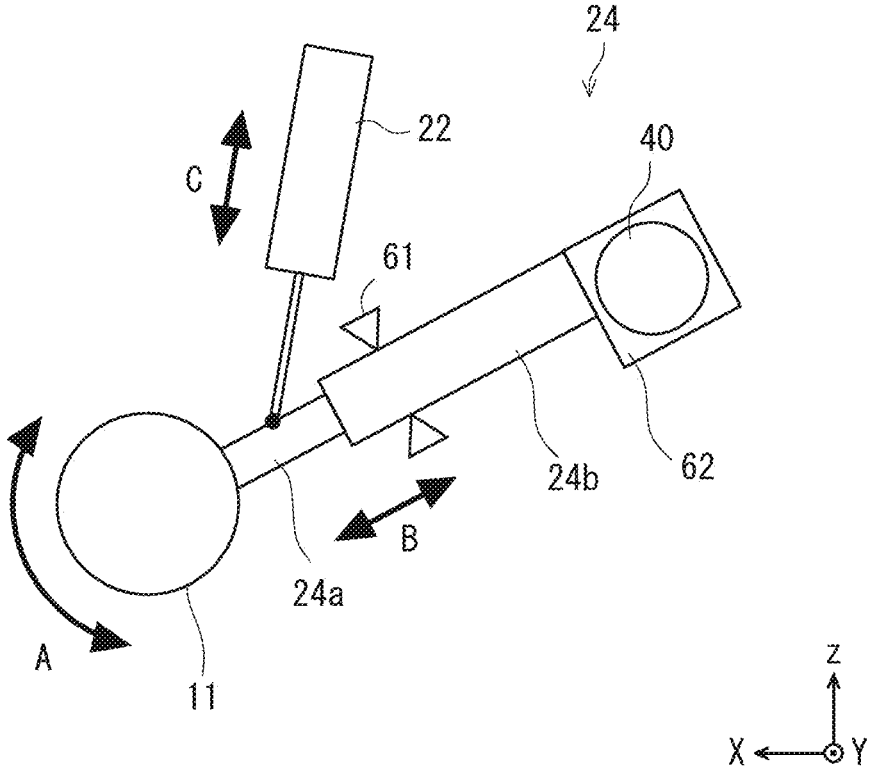
FIG. 5 is a diagram for describing operations of a first link.

Next, with reference to FIG. 5, operations of the first links 24 will be explained. FIG. 5 is a schematic view for describing the operations of the first link 24 by the first linear motion mechanisms 22. The first link 24 includes a movable part 24*a* and a base part 24*b*. The first link 24 further includes a linear brake 61 and an oscillation brake 62.

The base part 24*b* is attached to the frame 21 (not shown in FIG. 5) via the oscillation axis 40. The movable part 24*a* is slidably moved with respect to the base part 24*b* (arrow B in FIG. 5). The movable part 24*a* is attached to the base part 24*b* via, for example, a linear guide. The movable part 24*a* is slidably moved with respect to the base part 24*b*, whereby the length of the first link 24 is changed. That is, the distance between the oscillation axis 40 and the front wheel 11 is changed.

The first linear motion mechanism 22 is attached to the movable part 24*a*. Specifically, the end of the first linear motion mechanism 22 is fixed to the movable part 24*a*. The first linear motion mechanism 22 is extended and retracted, which causes the first link 24 to be rotated about the oscillation axis 40 (arrow A in FIG. 5). When the first linear motion mechanism 22 is extended in FIG. 5, the first link 24 is rotated in a counterclockwise direction. When the first linear motion mechanism 22 is retracted, the first link 24 is rotated in a clockwise direction.

Further, since the first linear motion mechanism 22 is extended and retracted (arrow C in FIG. 5), the movable part 24*a* is slid with respect to the base part 24*b*. When the first linear motion mechanism 22 is extended, the length of the first link 24 becomes longer. That is, the distance from the oscillation axis 40 to the front wheel 11 becomes longer. When the first linear motion mechanism 22 is retracted, the length of the first link 24 becomes shorter. That is, the distance from the oscillation axis 40 to the front wheel 11 becomes shorter.

As described above, the first link 24 includes a passive linear motion joint. The first link 24 is an extendable and retractable link. The first linear motion mechanism 22 changes the angle of the first link 24 about the oscillation axis 40 and changes the length of the first link 24.

The first link 24 is further provided with the linear brake 61 and the oscillation brake 62. The linear brake 61 and the oscillation brake 62, which are, for example, electromagnetic brakes, operate in accordance with control signals.

The linear brake 61 restricts the slide movement of the movable part 24*a* with respect to the base part 24*b*. That is, the movable part 24*a* is not slidably moved during the operation of the linear brake 61, whereby the length of the first link 24 becomes constant.

The oscillation brake 62 restricts the rotation of the first link 24 about the oscillation axis 40, that is, the first link 24 is not rotated during the operation of the oscillation brake 62, whereby the angle of the first link 24 with respect to the frame 21 becomes constant.

When the oscillation brake 62 and the linear brake 61 are not operated, the first linear motion mechanisms 22 are extended and retracted, which causes the rotation angle and the length of the first link 24 to be changed. While the linear brake 61 is not being operated and the oscillation brake 62 is being operated, the first linear motion mechanism 22 is extended and retracted, whereby it is possible to adjust the length of the first link 24 (arrow B). Further, while the oscillation brake 62 is not being operated and the linear brake 61 is being operated, the first linear motion mechanism 22 is extended and retracted, whereby it is possible to adjust the angle of the first link 24 (arrow A).

Accordingly, the first links 24 may be made to have a desired length in a state in which the first links 24 has a desired angle. Alternatively, it is possible to make the first links 24 have a desired angle in a state in which the first links 24 have a desired length. Since the angle and the length of the first links 24 can be independently controlled, the vehicle 1 may be adapted to steps with various heights.

When, for example, the front wheels 11 ascend a step, the oscillation brake 62 is operated, and the oscillation and rotation of the first links 24 are restricted. Then, in a state in which the oscillation and rotation are restricted, the first linear motion mechanisms 22 are operated and the length of the first links 24 is determined. Note that the length of the first links 24 can be determined in accordance with the height of the step. A sensor that will be explained later measures the height of the step before the front wheels 11 ascend the step. The first linear motion mechanisms 22 adjust the length of the first links 24 in such a way that this length becomes equal to the length in accordance with the height of the step measured by the sensor.

The linear brake 61 is operated in a state in which the length of the first links 24 becomes a predetermined length. Further, when the oscillation brake 62 is released to operate the first linear motion mechanisms 22, the first links 24 are rotated. That is, the first links 24 are rotated with respect to the frame 21 in a state in which the length of the first links 24 is constant. It is therefore possible to raise the front wheels 11 to a desired height. That is, the front wheels 11 can be raised to a position higher than the step.

Further, when the front wheels 11 descend the step, the oscillation brake 62 is operated and the oscillation and rotation of the first links 24 are restricted. Then, in the state in which the oscillation and rotation are restricted, the first linear motion mechanisms 22 are operated and the length of the first links 24 is determined. Note that the length of the first links 24 can be determined in accordance with the height of the step. The sensor that will be described later measures the height of the step before the front wheels 11 descend the step. The first linear motion mechanisms 22 adjust the length of the first links 24 in such a way that this length becomes equal to the length in accordance with the height of the step measured by the sensor.

The linear brake 61 is operated in a state in which the length of the first links 24 becomes a predetermined length. When the oscillation brake 62 is released to operate the first linear motion mechanisms 22, the first links 24 are rotated. That is, the first links 24 are rotated with respect to the frame 21 in a state in which the length of the first links 24 is constant. It is therefore possible to lower the front wheels 11 to a desired height. That is, the front wheels 11 can be lowered to the floor surface of the step.

According to this structure, the first links can be appropriately controlled, whereby the vehicle 1 is able to definitely climb up or go down the step. For example, it is possible to prevent the front wheels 11 from being brought into contact with the corner part of the step. That is, the length and the angle of the first links 24 may be adjusted in such a way that the front wheels 11 are brought into contact with a flat part of the step. The vehicle 1 is able to climb up and go down, for example, a higher step or a step having a shorter distance in the front-back direction. That is, the vehicle 1 can be adapted to steps of various shapes.

Dilatant Fluid

Figure 6:
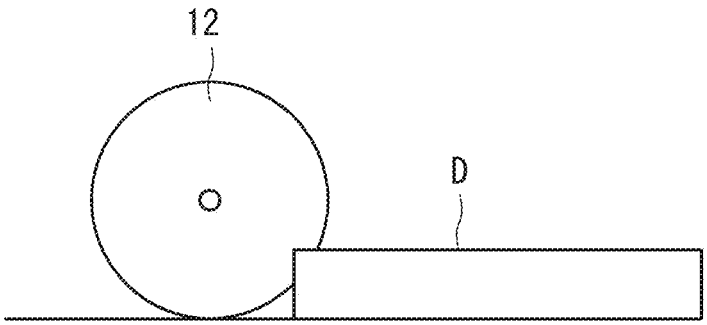
FIG. 6 is a diagram showing a state in which a wheel having a dilatant fluid included therein hits a step.

In some embodiments, at least one of the front wheels 11, the middle wheels 12, and the rear wheels 13 has a dilatant fluid included therein. More specifically, in some embodiments, the middle wheels 12 or the rear wheels 13 have a dilatant fluid included therein. The dilatant fluid generates a resistance force like a solid when it receives an impact, and behaves like a liquid when it no longer receives an impact. Therefore, if the middle wheels 12 receive an impact at the corner part of the step when the vehicle 1 climbs up or goes down a step, the middle wheels 12 hold the shape in accordance with the corner part. As shown in FIG. 6, the middle wheels 12 are fixed in a shape in accordance with the corner part of the step D. Accordingly, the middle wheels 12 get stuck on the corner of the step D, whereby the vehicle 1 is able to climb up or go down steps like stairs more definitely.

Instead of employing the structure in which the dilatant fluid is included only in the middle wheels 12, a configuration in which the dilatant fluid is not included in the front wheels 11 and is included in the middle wheels 12 and the rear wheels 13 may be employed. Otherwise, the dilatant fluid may not be included in the front wheels 11 and the middle wheels 12 and may be included in the rear wheels 13.

Since the first linear motion mechanisms 22 are able to raise and lower the front wheels 11, the front wheels 11 can be lowered to a flat part of the step. On the other hand, since it is possible that the middle wheels 12 and the rear wheels 13 may come into contact with the corner part of the step, in some embodiments, at least one of the middle wheels 12 and the rear wheels 13 has a dilatant fluid included therein. Accordingly, the wheels can be deformed in accordance with the shape of the corner part, whereby the vehicle 1 is able to easily climb up or go down steps. In some embodiments, at least one of the driving wheels has a dilatant fluid included therein. In some embodiments, at least one of the middle wheels 12 and the rear wheels 13 have a dilatant fluid included therein. Further, the front wheels 11 may be wheels that do not have a dilatant fluid included therein, that is, wheels that have gas like air included therein. In this case, the weight of the front wheels 11 can be reduced, whereby it is possible to reduce the size and the weight of the first linear motion mechanisms 22.

Mode Switching

Figure 7:
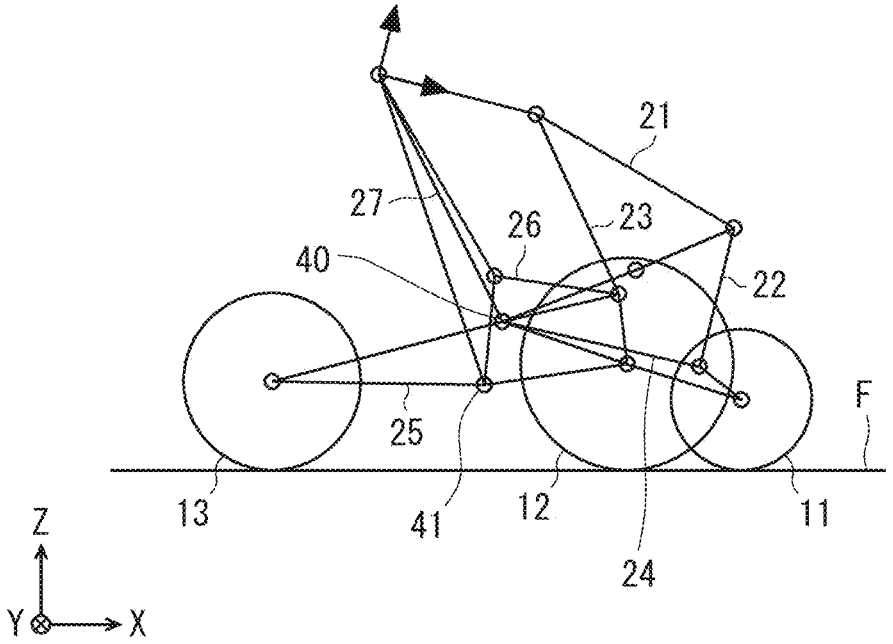
FIG. 7 is a side view schematically showing a structure of a variable mechanism in a chair mode.
Figure 8:
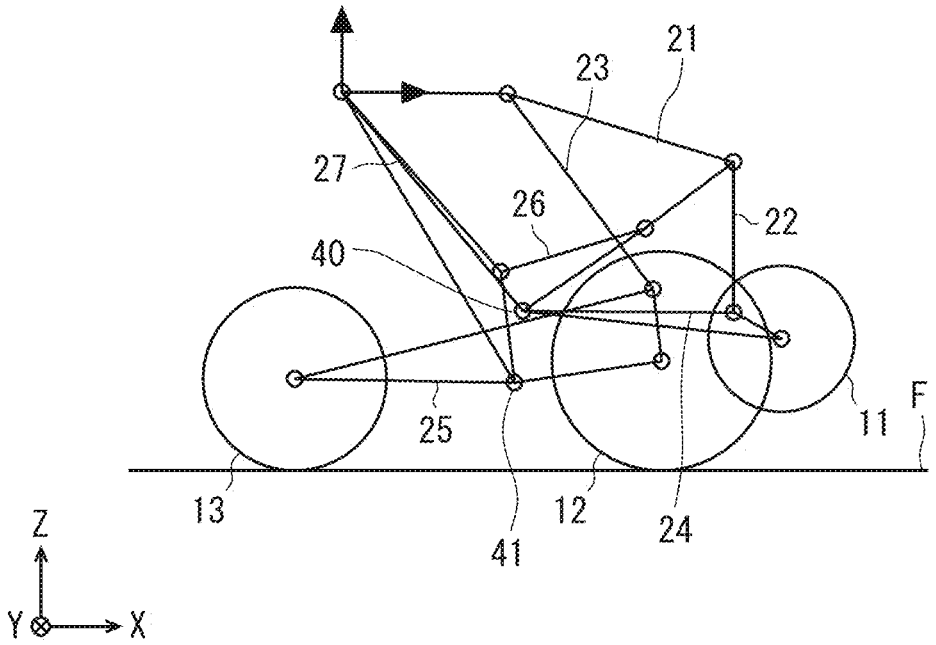
FIG. 8 is a side view schematically showing a structure of the variable mechanism in a drive mode.
Figure 9:
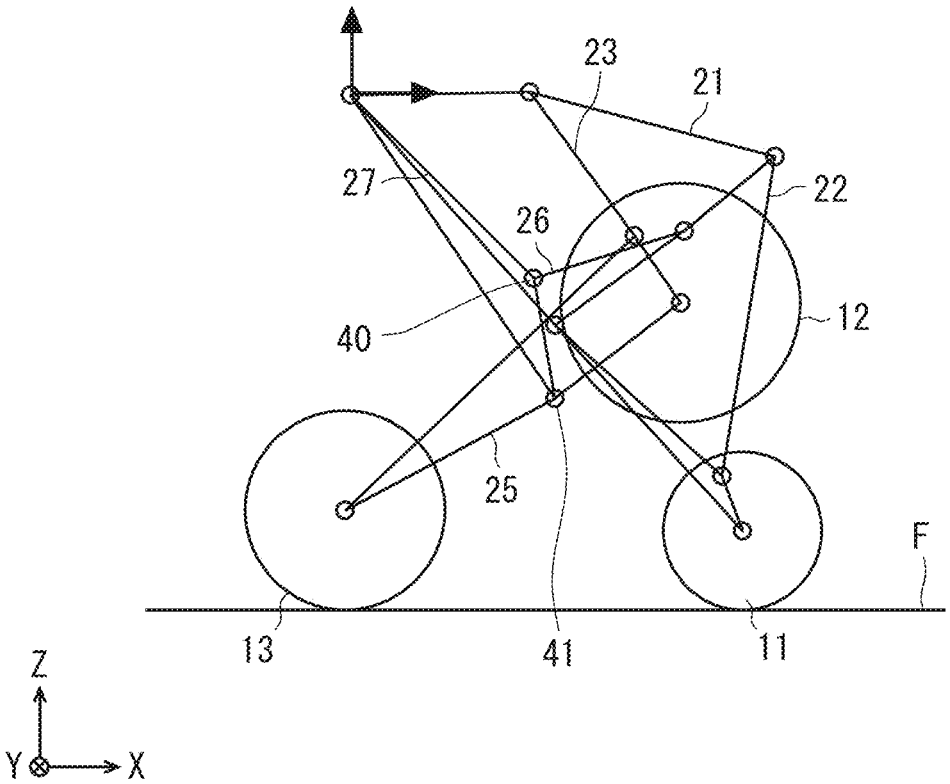
FIG. 9 is a side view schematically showing a structure of the variable mechanism in a stand mode.

The variable mechanism 20 is able to switch the operation modes of the vehicle 1. The vehicle 1 is able to travel in a chair mode, a drive mode, or a stand mode. FIG. 7 is a side view showing the variable mechanism 20 in the chair mode in a simplified view. FIG. 8 is a side view showing the variable mechanism 20 in the drive mode in a simplified view, and FIG. 9 is a side view showing the variable mechanism 20 in the stand mode in a simplified view. The vehicle height of the vehicle 1, i.e., the height of the seating surface from a floor surface F, varies for each mode.

In the chair mode, the vehicle 1 is in a six-wheel grounded state in which the front wheels 11, the middle wheels 12, and the rear wheels 13 are all grounded on the floor surface F. In the drive mode, the vehicle 1 is in a four-wheel grounded state in which the front wheels 11 are off the ground and the middle wheels 12 and the rear wheels 13 are grounded on the floor surface F. In the stand mode, the vehicle 1 is in a four-wheel grounded state in which the front wheels 11 and the rear wheels 13 are grounded on the floor surface F and the right and left middle wheels 12 are off the ground.

The riding seat becomes the lowest in the chair mode and the riding seat becomes the highest in the stand mode. In the drive mode, the height of the riding seat becomes higher than that in the chair mode but lower than that in the stand mode.

Figure 10:
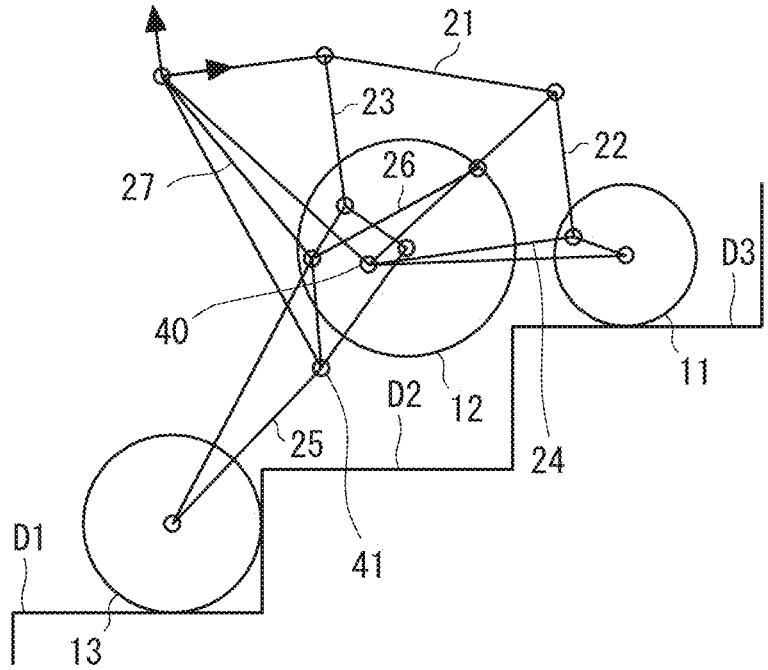
FIG. 10 is a side view schematically showing a structure of the variable mechanism in an up escalator.
Figure 10:
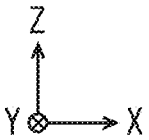
Figure 11:
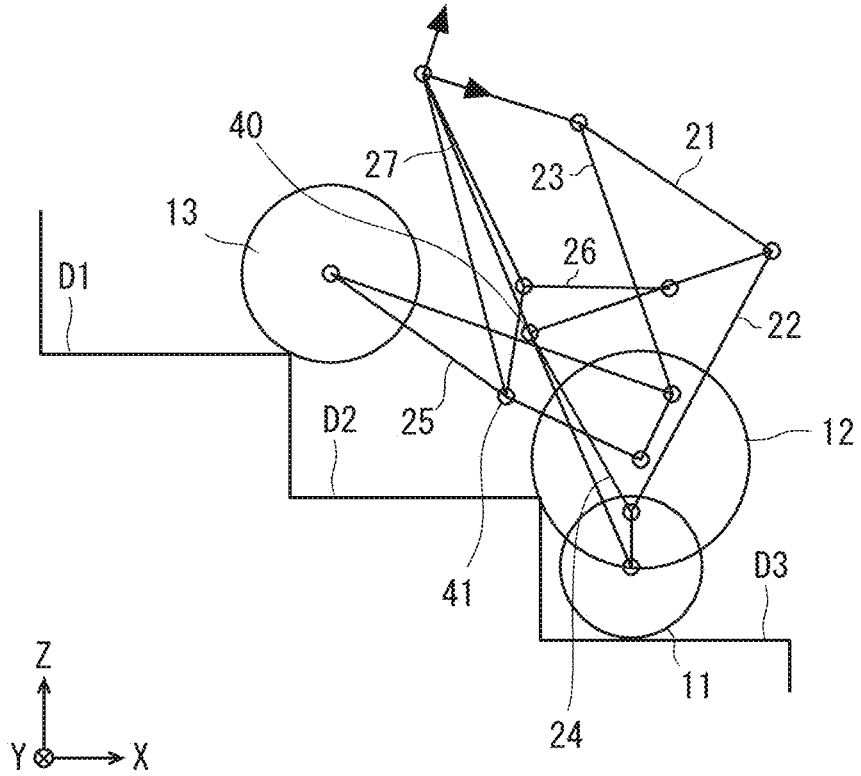
FIG. 11 is a side view schematically showing a structure of the variable mechanism in a down escalator.

Further, the variable mechanism 20 can operate in such a way that the vehicle 1 is able to climb up or go down two or more steps. This structure allows the vehicle 1 to get on escalators and ascend and descend stairs. FIG. 10 is a side view showing the variable mechanism 20 in an ascending staircase or an up escalator in a simplified view. FIG. 11 is a side view which shows the variable mechanism 20 in a descending staircase or a down escalator in a simplified view. In FIGS. 10 and 11, the first step is denoted by D1, the second step is denoted by D2, and the third step is denoted by D3.

As shown in FIG. 10 or 11, when the vehicle 1 is adapted to two or more steps, the right and left front wheels 11 and rear wheels 13 are grounded in the vehicle 1. The rear wheels 13 are grounded on the step D1 and the front wheels 11 are grounded on the step D3, which is two steps ahead of the step on which the rear wheels 13 are grounded. In FIG. 10, the vehicle 1 is in a four-wheel grounded state in which the right and left middle wheels 12 are off the ground. In FIG. 11, the right and left middle wheels 12 are grounded on the corner of the step D2. As a matter of course, the middle wheels 12 may be grounded on the step D2 or may not be grounded thereon.

Operations of Climbing Up or Going Down Steps

Figure 12:
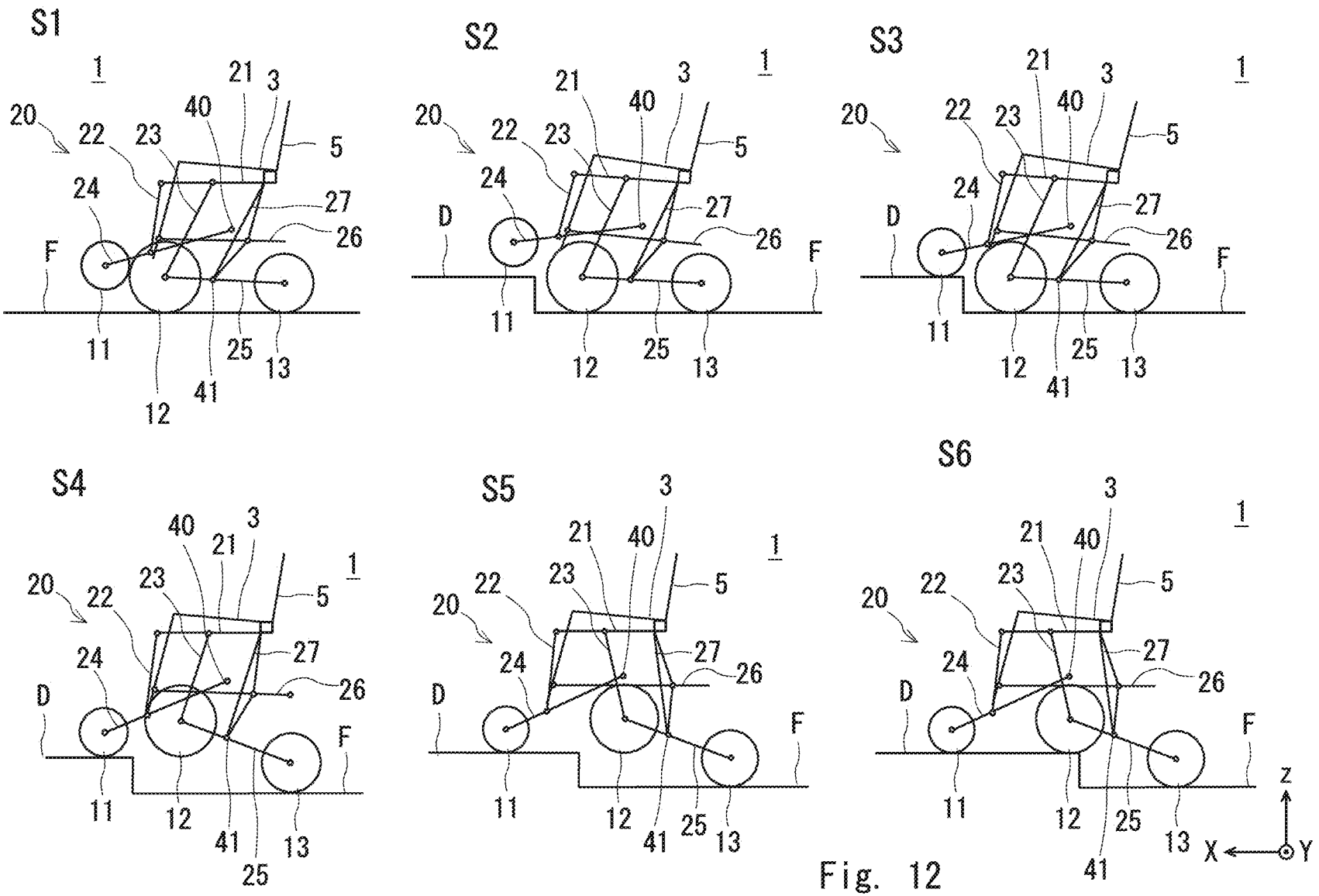
FIG. 12 is a side view for describing an operation of climbing up or going down a step.
Figure 13:
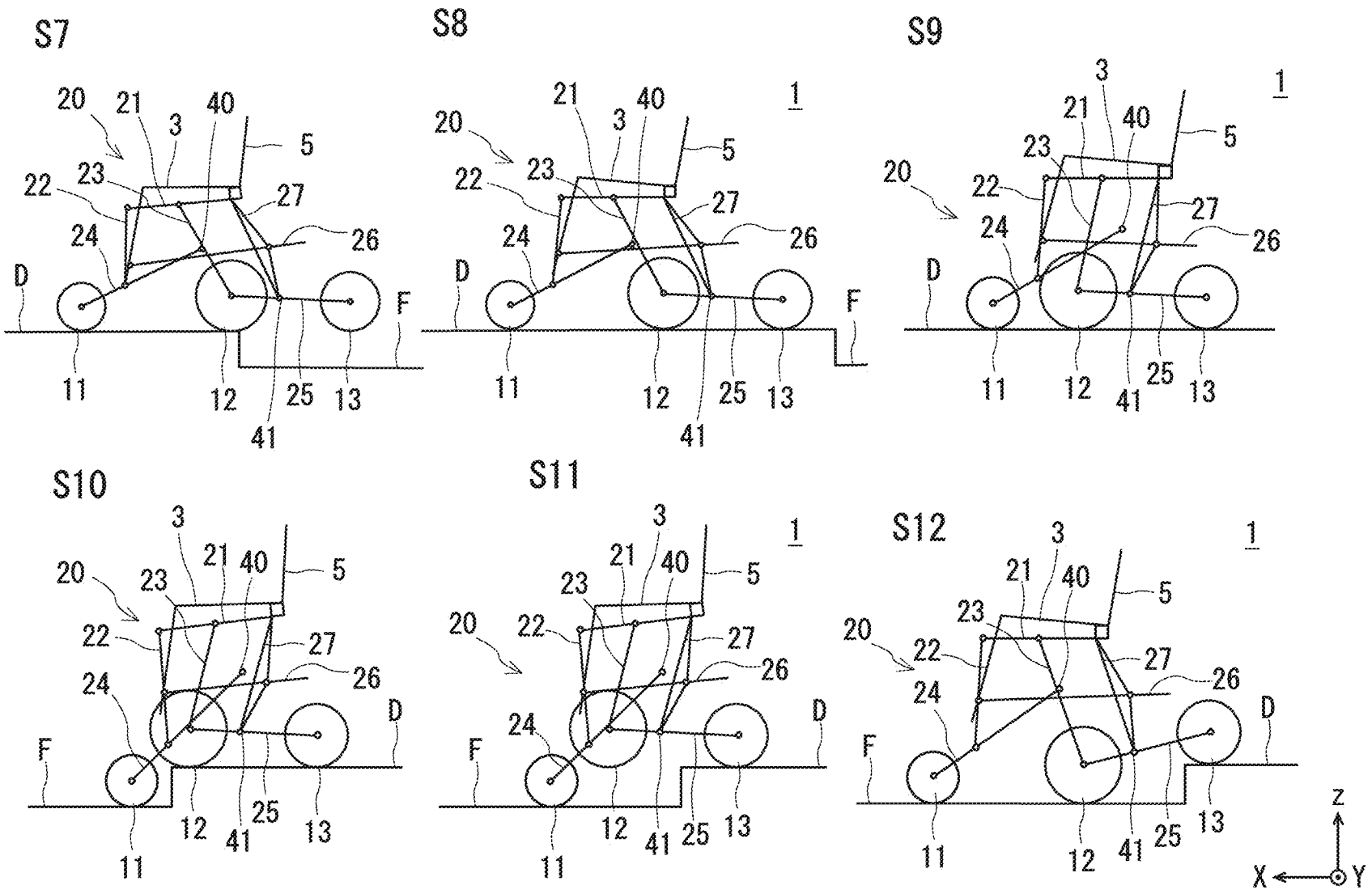
FIG. 13 is a side view for describing an operation of climbing up or going down a step.
Figure 14:
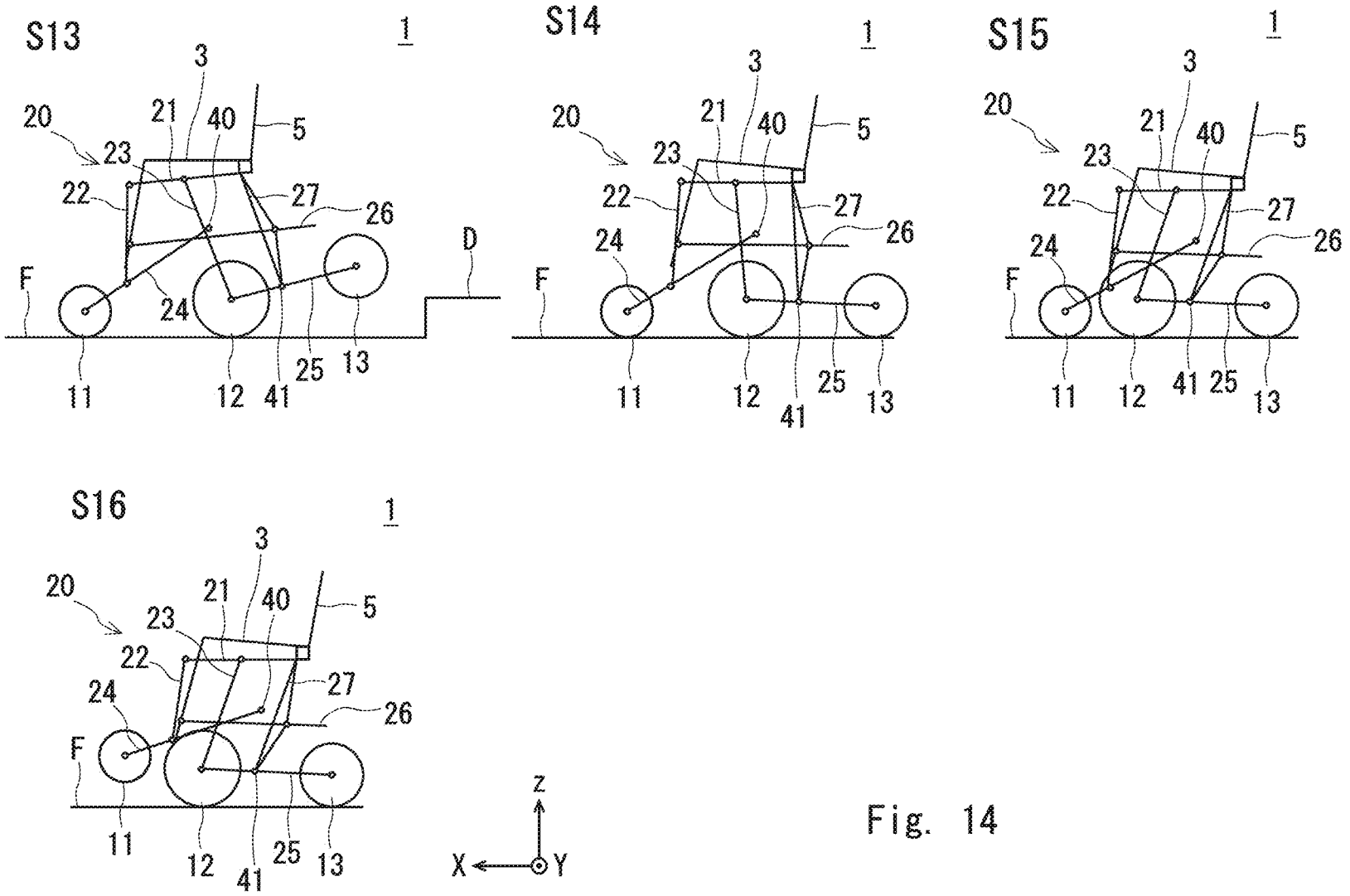
FIG. 14 is a side view for describing an operation of climbing up or going down a step.

Next, with reference to FIGS. 12-14, operations of climbing up or going down the steps will be explained. FIGS. 12-14 are side views schematically showing operations in which the vehicle 1 climbs up or goes down one step D provided on the floor surface F. FIGS. 12-14 show operations in which the vehicle 1 climbs up or goes down a step in an order of Steps S1 to S16. Specifically, Steps S1-S8 show a series of operations of ascending the step D from the floor surface F. Steps S9-S16 show a series of operations in which the vehicle 1 descends from the step D to the floor surface F. In FIGS. 12-14, the vehicle 1 travels in the left direction, which is defined as the front side. Further, it is assumed that, in the X direction, the step D has a sufficiently large length compared to the vehicle 1.

The vehicle 1 is travelling in the drive mode (S1). Specifically, the vehicle 1 is travelling in a four-wheel grounded state in which the front wheels 11 are off the ground and the middle wheels 12 and the rear wheels 13 are grounded on the floor surface F. When the vehicle 1 reaches in front of the step D, a sensor that will be described later detects the presence of the step D and the height of the step D. When the vehicle 1 arrives just before the step D, the front wheels 11 are raised. Specifically, the first linear motion mechanisms 22 are retracted, which causes the first links 24 to be rotated about the oscillation axis 40. Accordingly, the first links 24 are rotated in a clockwise direction and the front wheels 11 are raised to a position higher than the step D. Then the middle wheels 12 and the rear wheels 13 are rotated, whereby the vehicle 1 travels straight forward and the front wheels 11 are moved just above the step D (S2). In order to raise the front wheels 11, the wheel brake of the middle wheels 12 may be operated while the first linear motion mechanisms 22 are being retracted.

The front wheels 11 are grounded on the step D (S3). Specifically, the first linear motion mechanisms 22 are extended, whereby the front wheels 11 are lowered and grounded on the step D. First, the first linear motion mechanisms 22 are extended in a state in which the oscillation brake 62 restricts the oscillation and rotation, whereby the first links 24 have a length according to the step. When the first links 24 have a desired length, the linear brake 61 is operated and the length of the first links 24 is fixed. Then, after the oscillation brake 62 is released, the first linear motion mechanisms 22 are stretched and the first links 24 are rotated about the oscillation axis 40. Accordingly, the first links 24 are rotated in a counterclockwise direction and the front wheels 11 are grounded on the step D. In S3, the middle wheels 12 and the rear wheels 13 are grounded on the floor surface F.

The middle wheels 12 are raised to the height of the step D (S4). Specifically, the second linear motion mechanisms 23 are retracted, which causes the second links 25 to be rotated about the rotation axis 41. Accordingly, the second links 25 are rotated in a clockwise direction and the middle wheels 12 are off the ground. In S4, the front wheels 11 are grounded on the step D and the rear wheels 13 are grounded on the floor surface F. Note that the wheel brake of the front wheels 11 may be operated while the middle wheels 12 are being raised.

The vehicle 1 increases the wheelbase between the front wheels 11 and the rear wheels 13 (S5). Specifically, the brake of the front wheels 11 is released and the third linear motion mechanism 26 is extended, which causes the wheelbase to be increased. In S5, like in the state described in S4, the front wheels 11 are grounded on the step D, the middle wheels 12 are off the ground, and the rear wheels 13 are grounded on the floor surface F.

When the rear wheels 13 are rotated and the vehicle 1 travels forward, the middle wheels 12 are grounded on the step D (S6). The front wheels 11 and the middle wheels 12 are grounded on the step D and the rear wheels 13 are grounded on the floor surface F. In this state, the wheel brakes of the front wheels 11 and the middle wheels 12 are operated, thereby restricting rotations of the front wheels 11 and the middle wheels 12.

The rear wheels 13 are raised to the height of the step D (S7). Specifically, the second linear motion mechanisms 23 are extended, which rotates the second links 25 about the rotation axis 41. Accordingly, the second links 25 are rotated in a counterclockwise direction and the rear wheels 13 are raised onto the step D. Further, the third linear motion mechanism 26 is extended. In this example, the front wheels 11 and the middle wheels 12 are grounded on the step D and the rear wheels 13 are off the ground.

When the middle wheels 12 are rotated and the vehicle 1 travels forward, the rear wheels 13 are grounded on the step D (S8). Accordingly, the front wheels 11, the middle wheels 12, and the rear wheels 13 are grounded on the step D, whereby the vehicle 1 is in a six-wheel grounded state. According to the above operations, the operation in which the vehicle 1 ascends the step is completed.

The vehicle 1 reduces the wheelbase between the front wheels 11 and the rear wheels 13 on the step D (S9). Specifically, the third linear motion mechanism 26 is retracted. In S9, like in the state described in S8, the vehicle 1 is in a six-wheel grounded state in which the front wheels 11, the middle wheels 12, and the rear wheels 13 are grounded on the step D.

When the vehicle 1 moves to an end of the step D, the first linear motion mechanisms 22 lower the front wheels 11 from the step D (S10). The vehicle 1 travels until the front wheels 11 get over the edge of the step D and are off the ground from the floor surface F. Specifically, the vehicle 1 travels until the middle wheels 12 come to a place on the edge of the step D. The first linear motion mechanisms 22 are extended in a state in which the oscillation brake 62 is operated and the linear brake 61 is released. Accordingly, the first links 24 have a predetermined length in accordance with the height of the step D. Then the linear brake 61 is operated, and then the oscillation brake 62 is released. Further, the first linear motion mechanisms 22 are extended, which causes the first links 24 to be rotated. Accordingly, the front wheels 11 are grounded on the floor surface F. In S10, the middle wheels 12 and the rear wheels 13 are grounded on the step D.

When the middle wheels 12 and the rear wheels 13 are rotated and the vehicle 1 travels forward, the middle wheels 12 get over the edge of the step D (S11). In S11, the front wheels 11 are grounded on the floor surface F, the middle wheels 12 are off the ground, and the rear wheels 13 are grounded on the step D.

Then the middle wheels 12 are grounded on the floor surface (S12). Specifically, the second linear motion mechanisms 23 are extended and the third linear motion mechanism 26 is extended. Accordingly, the front wheels 11 and the middle wheels 12 are grounded on the floor surface F and the rear wheels 13 are grounded on the step D. Further, the wheelbase between the front wheels 11 and the rear wheels 13 is increased.

When the middle wheels 12 are rotated and the vehicle 1 travels forward, the rear wheels 13 descend the step D (S13). That is, the rear wheels 13 get over the edge of the step D. In S13, the front wheels 11 and the middle wheels 12 are grounded on the floor surface F and the rear wheels 13 are off the ground.

The rear wheels 13 are grounded and the vehicle 1 is in a six-wheel grounded state (S14). Specifically, the second linear motion mechanisms 23 are retracted, which causes the second links 25 to be rotated. Further, the third linear motion mechanism 26 is retracted. According to the above operations, the vehicle 1 is able to get over the step D.

The middle wheels 12 are moved forward (S15). Specifically, the third linear motion mechanism 26 is retracted. The front wheels 11 are raised, the mode of the vehicle 1 is changed to the drive mode (S16). Specifically, the first linear motion mechanisms 22 are retracted and the first links 24 are rotated. Accordingly, the front wheels 11 are off the ground. In S16, the mode of the vehicle 1 is changed to the drive mode in which the middle wheels 12 and the rear wheels 13 are grounded.

As described above, the vehicle 1 is able to climb up and go down the step D. It is thus possible for the vehicle 1 to be adapted to various environments. The ride quality can be improved also when the vehicle 1 climbs up and goes down steps.

As described above, in this embodiment, when the first linear motion mechanisms 22 linearly move, the first links 24, which are the front legs, are rotationally oscillated. It is thus possible for the vehicle 1 to climb up or go down a high step with a short stroke compared to a configuration in which front legs are directly extended and retracted by linear motion mechanisms. It is therefore possible to reduce an amount of protrusion of the second linear motion mechanisms 23 and to prevent the second linear motion mechanisms 23 from interfering with the occupant.

Operations of Ascending Stairs

Figure 15:
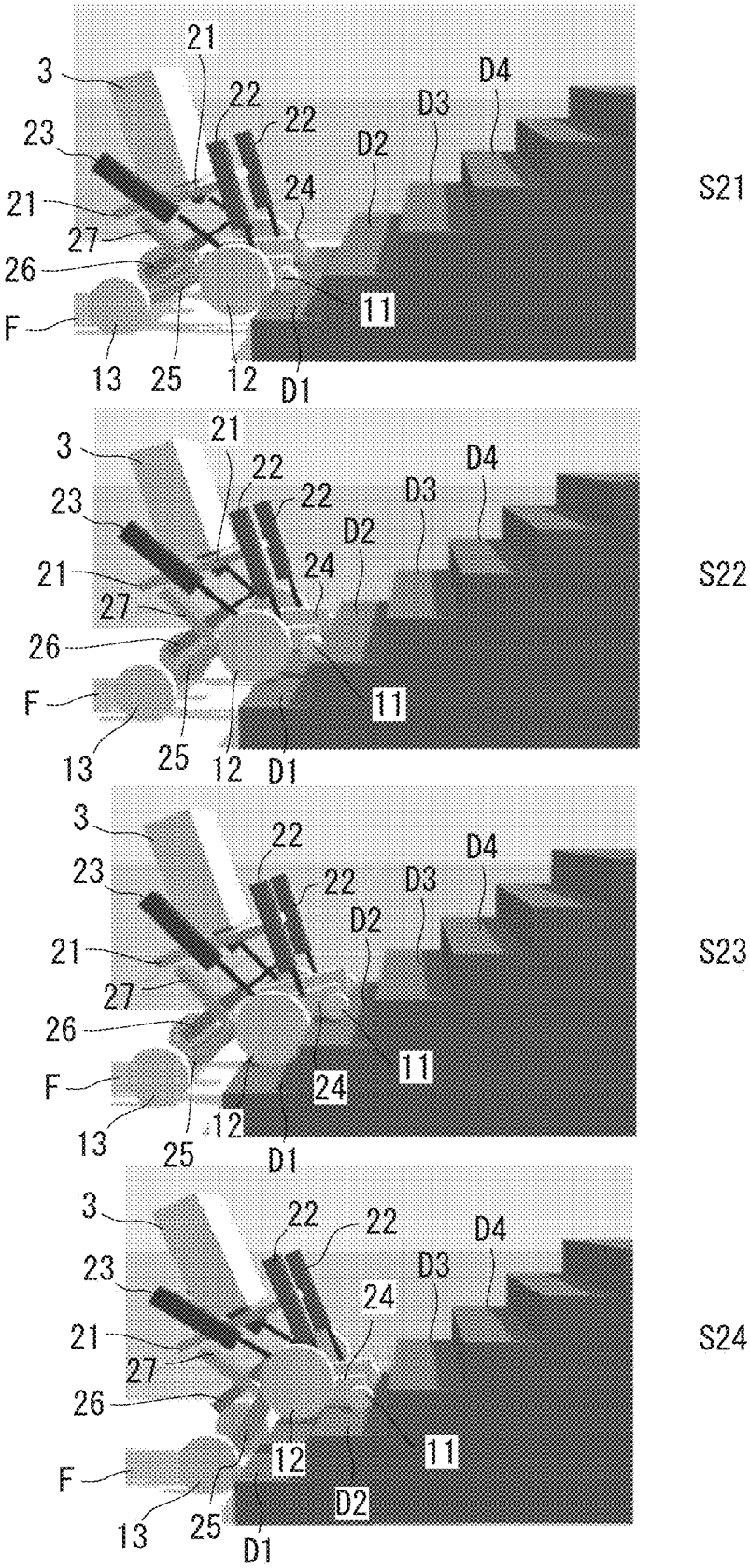
FIG. 15 is a diagram showing an operation of ascending two or more stairs.
Figure 16:
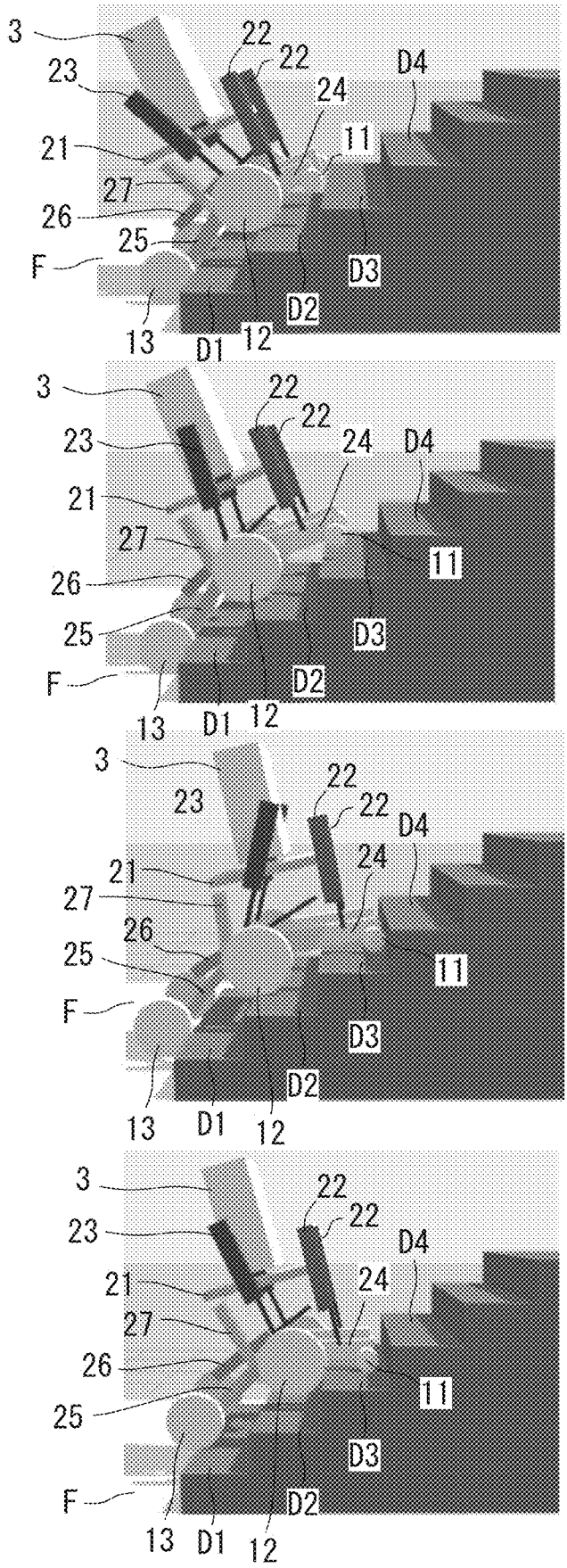
FIG. 16 is a diagram showing an operation of ascending two or more stairs.

FIGS. 15 and 16 are schematic views each showing the operation in which the vehicle 1 ascends a plurality of stairs. FIGS. 15 and 16 show operations of climbing up or going down the steps in an order of Steps S21 to S28. The first step of the stairs is denoted by a step D1, the second step is denoted by a step D2, and the third step is denoted by a step D3, etc.

Step1: raise the front wheels (S21)
Step2: move forward until the front wheels are on step D1 (S21)
Step3: raise the middle wheels (S21)
Step4: move forward until the middle wheels are on step D1 (S22)
Step5: raise the front wheels (S22)
Step6: move forward until the front wheels are on step D2 (S23)
Step7: raise the middle wheels (S24)
Step8: move forward until the middle wheels are on step D2 (S24)
Step9: raise the front wheels (S25)
Step10: increase the wheelbase until the front wheels are on step D3 (S26)
Step11: raise the rear wheels, reduce the wheelbase, and move forward until the rear wheels are on step D1 (S28)
Go back to step7 and repeat.

Control System

Figure 17:
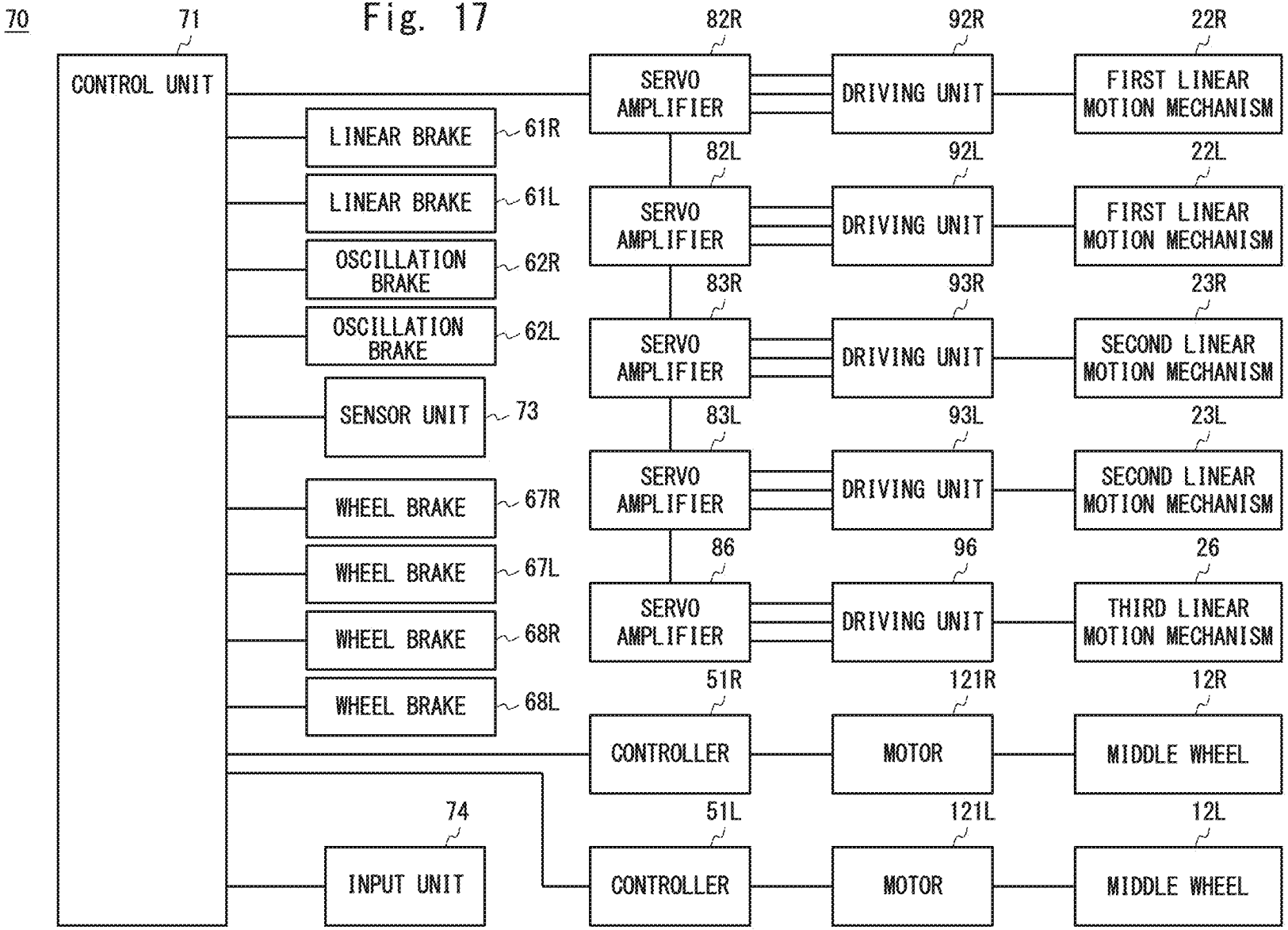
FIG. 17 is a block diagram showing a control system of a vehicle.

With reference to FIG. 17, a control system of the vehicle 1 according to this embodiment will be described. FIG. 17 is a block diagram showing a configuration of a control system 70. The control system 70 includes a control unit 71, a sensor unit 73, and an input unit 74. The control system 70 further includes servo amplifiers 82, 83, and 86, and driving units 92, 93, and 96 in order to control driving of the first linear motion mechanisms 22, the second linear motion mechanisms 23, and the third linear motion mechanism 26, respectively. The control system 70 further includes controllers 51 and motors 121 in order to control driving of the middle wheels 12.

Note that in a manner similar to the above described one, the components on the right and left sides are denoted by R and L, respectively. When it is not necessary to especially differentiate a right component from a left component, these components will be described without adding L or R thereto. Some of the components of the control system 70 may be accommodated inside, for example, the input unit 74 or the riding seat 3.

The input unit 74 is a keyboard, a joypad, or the like and receives inputs regarding a movement direction and a posture of the vehicle 1. For example, the occupant operates the input unit 74 to input the movement direction, the movement speed, or the posture.

The sensor unit 73 is composed of one or a plurality of sensors. The sensor unit 73 includes, for example, an angle sensor that measures the posture of the riding seat 3. To be more specific, the sensor unit 73 includes a six-axis gyro sensor that detects acceleration rates at X-axis, Y-axis, and Z-axis and detects angular speeds around the X-axis, the Y-axis, and the Z-axis. The gyro sensor is installed to become parallel to the seating surface of the riding seat 3. Thus, the gyro sensor detects an inclination angle of the seating surface. The sensor unit 73 further includes various sensors such as a laser range scanner that contactlessly detects a height of a step on a road surface, a camera, or the like.

The control unit 71 is an arithmetic processing unit such as a Central Processing Unit (CPU) and a Personal Computer (PC) including a memory, and controls the entire vehicle 1. The control unit 71 outputs control signals to the controllers 51R and 51L and the servo amplifiers 82, 83, and 86 in order to control the middle wheels 12.

The controllers 51R and 51L are motor controllers that control the motors 121R and 121L, respectively. The motors 121R and 121L have configurations similar to each other and drive the middle wheels 12R and 12L, respectively. Thus, the middle wheels 12R and 12L are rotated in such a way that the vehicle 1 is moved in the movement direction at the movement speed input in the input unit 74. For example, the control unit 71 generates control signals according to input signals input in the input unit 74. The control unit 71 outputs the control signals to the controllers 51. The controllers 51 output command values in accordance with the control signals to the motors 121. Thus, the middle wheels 12 connected to the motors 121 are rotated at a desired rotation speed. The motors 121R and 121L drive the middle wheels 12R and 12L, respectively, to be rotated independently from each other. Further, as described above, the driving forces of the motors 121 are transmitted to the rear wheels 13 via the transmission mechanisms 122.

Each of the driving units 92, 93, and 96 includes a servomotor, an encoder, and a brake. The driving units 92, 93, and 96 have configurations similar to one another and drive the first linear motion mechanisms 22, the second linear motion mechanisms 23, and the third linear motion mechanism 26, respectively. The servo amplifiers 82 are amplifiers for controlling driving of the servomotors in the driving units 92, 93, and 96, respectively.

For example, the control unit 71 controls driving of the driving units 92 via the servo amplifiers 82. For example, the control unit 71 outputs control signals to the servo amplifiers 82 in order to move the first linear motion mechanisms 22 to predetermined linear motion axis positions. The servo amplifiers 82 drive the driving units 92 based on the control signals. The encoders in the driving units 92 detect rotation angles of the servomotors. Then, the encoders output the detected rotation angles to the servo amplifiers 82 as feedback signals. The servo amplifiers 82 perform feedback control on the servomotors based on the feedback signals so that the servomotors will have rotation angles according to the control signals. Then, the first linear motion mechanisms 22 are driven to be at the predetermined linear motion axis positions.

Likewise, the control unit 71 controls driving of the driving units 93 and 96 via the servo amplifiers 83 and 86, respectively. Thus, the first linear motion mechanisms 22, the second linear motion mechanisms 23, and the third linear motion mechanism 26 will have predetermined lengths. As described above, the control unit 71 controls the first linear motion mechanisms 22, the second linear motion mechanisms 23, and the third linear motion mechanism 26. In this manner, the variable mechanism 20 can change the posture of the vehicle 1 so that it becomes a desired posture.

Further, the control unit 71 controls the operations of the linear brakes 61R and 61L. That is, ON/OFF of each of the linear brakes 61R and 61L are controlled by the control signals from the control unit 71. When the linear brakes 61R and 61L are operated, the extension and the retraction of the first links 24R and 24L are restricted. The linear brakes 61R and 61L may be controlled independently from each other or in association with each other.

Likewise, the control unit 71 controls operations of the oscillation brakes 62R and 62L. That is, ON/OFF of the oscillation brakes 62R and 62L are controlled by the control signals from the control unit 71. When the oscillation brakes 62R and 62L are operated, the oscillation and rotation of the first links 24R and 24L are restricted. The oscillation brakes 62R and 62L may be controlled independently from each other or in association with each other. The wheel brakes 67R and 67L restrict the rotation of the front wheels 11R and 11L, respectively. The wheel brakes 68R and 68L restrict the rotation of the middle wheels 11R and 11L, respectively.

According to the above operations, the front wheels 11R and 11L can be grounded on a flat part of the step. That is, since the front wheels 11R and 11L are grounded on a part other than the corner part of the step, the vehicle 1 is able to stably climb up or go down the steps. Note that the control unit 71 may determine the length and the angle of the first links 24 in accordance with the shape of the steps detected by the sensor unit 73. For example, the length and the angle with which the first links 24 are controlled may be determined in advance in accordance with the shape of the step.

A part or whole of the above control by the control unit 71 may be executed by a computer program. In this case, the control unit 71 is composed of hardware such as a processor and the like and software stored in a memory or the like. The program executed by the control unit 71 can be stored and provided to a computer using any type of non-transitory computer readable media. Non-transitory computer readable media include any type of tangible storage media. Examples of non-transitory computer readable media include magnetic storage media (such as flexible disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (Random Access Memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

Note that in the above descriptions, although the travelling apparatus according to this embodiment has been described as the vehicle 1 on which the occupant rides and that travels, the travelling apparatus according to this embodiment may be configured not to carry the occupant. For example, the travelling apparatus according to this embodiment may travel with baggage loaded on a carrier. In this case, the carrier is provided on the frame 21 for the vehicle body in place of the riding seat 3. Alternatively, the travelling apparatus may carry baggage and the occupant at the same time. In this case, the vehicle body is provided with the riding seat 3 and the carrier. Further alternatively, it is not limited to the travelling apparatus that carries the occupant or baggage and is moved, and instead it may be configured in such a way that only the travelling apparatus itself is moved. For example, the structure of the travelling apparatus is not limited to the one in which the vehicle body is provided with the riding seat and the carrier, and may instead be a mobile robot or the like that autonomously travels. That is, the travelling apparatus may be configured such that the variable mechanism 20 supports the vehicle body. When the riding seat and/or the carrier is provided to the vehicle body, a vehicle on which the occupant rides or a travelling apparatus that carries baggage can be composed.

To sum up, the travelling apparatus according to one aspect of this embodiment includes the frame 21, the front wheels 11, the first links 24, and the first linear motion mechanisms 22. The frame 21 is the vehicle body. The front wheels 11 are the first wheels disposed in a front of the frame 21. The first links 24 that are configured to be extendable and retractable are coupled between the front wheels 11 and the oscillation axis 40 located in a rear of the front wheels 11. The first linear motion mechanisms 22, which are coupled between the frame 21 and the first links 24, are extended and retracted so as to rotate the first links 24 about the oscillation axis 40. The first linear motion mechanisms 22 oscillate and rotate the first links 24, which raises and lowers the front wheels 11. Accordingly, it is possible to increase the amount of the vertical movement of the front wheels 11 than the stroke of the first linear motion mechanisms 22. Accordingly, the travelling apparatus may be adapted to a step higher than the stroke of the first linear motion mechanisms 22. It is therefore possible to provide the travelling apparatus having a high travelling performance with a simple structure.

Further, the aforementioned travelling apparatus may include the oscillation brake 62, the linear brake 61, the middle wheels 12, and the second linear motion mechanisms 23. The oscillation brake 62 is a first brake that restricts the rotation of the first links 24 about the oscillation axis 40. The linear brake 61 is a second brake that restricts the extension and the retraction of the first links 24. The middle wheels 12 are the second wheels disposed in a rear of the front wheels 11. The second linear motion mechanisms 23 are driving mechanisms that raise and lower the middle wheels 12. With this structure, the length and the angle of the first links 24 can be appropriately controlled, whereby the travelling apparatus is able to definitely climb up or go down steps. It is thus possible to achieve a high travelling performance with a simple structure.

The aforementioned travelling apparatus may include the rear wheels 13 and the second links 25. The rear wheels 13 are the third wheels disposed in a rear of the middle wheels 12. The second links 25 couple together the middle wheels 12 and the rear wheels 13. The second linear motion mechanisms 23 are coupled between the second links and the vehicle body, and rotate the second links. According to this structure, the second linear motion mechanisms 23 are able to raise or lower the middle wheels 12 and the rear wheels 13, whereby the travelling apparatus is able to climb up or go down steps with a simple structure.

Further, in the aforementioned travelling apparatus, in some embodiments, at least two of the first to third wheels are driving wheels. It is therefore possible to improve travelling performance. Further, in some embodiments, at least one of the second and third wheels has a dilatant fluid included therein. It is therefore possible to improve travelling performance.

Further, in the aforementioned travelling apparatus, the first wheels, the second wheels, the third wheels, the first linear motion mechanisms, and the second linear motion mechanisms may be arranged on the right and left sides of the travelling apparatus and they may be driven independently on the right and left sides of the travelling apparatus. Further, the aforementioned travelling apparatus may further include a wheel brake that restricts rotations of the front wheels 12. Accordingly, the travelling apparatus can travel even in a case in which a step is provided in only one of the right and left sides or a case in which there are steps having heights different from one another.

Another travelling apparatus according to this embodiment may include the frame 21, the front wheels 11, the middle wheels 12, the rear wheels 13, and the first driving mechanisms. The front wheels 11 are the first wheels disposed in a front of the frame 21 and the middle wheels 12 are the second wheels disposed in a rear of the first wheels. The rear wheels 13 are the third wheels disposed in a rear of the second wheels. The first driving mechanisms raise and lower the front wheels 11. At least two of the front wheels 11, the middle wheels 12, and the rear wheels 13 are the driving wheels. Accordingly, even when there is a gap in front of a step, the front wheels 11 can be raised and lowered in a state in which the travelling apparatus comes close to the step. It is thus possible for the travelling apparatus to be adapted to steps of various shapes. It is possible to achieve a high travelling performance with a simple structure.

The aforementioned travelling apparatus may include the motors 121 and the transmission mechanisms 122. The motors are in-wheel motors provided in the middle wheels 12 or the rear wheels 13. The transmission mechanisms 122 transmit driving forces of the motors to the other one of the middle wheels 12 and the rear wheels 13. It is therefore possible to cause the middle wheels 12 and the rear wheels 13 to serve as the driving wheels with a simple structure. Therefore, even when the middle wheels 12 or the rear wheels 13 are off the ground, the vehicle 1 is able to obtain a forward driving force.

Another travelling apparatus according to this embodiment is a travelling apparatus capable of climbing up and going down a step, and includes the vehicle body and the wheels having a dilatant fluid included therein. Even when the wheels are brought into contact with the corner of the step, the wheels are deformed in such a way that the wheels have a shape in accordance with the corner part of the step. It is thus possible for the travelling apparatus to be adapted to steps of various shapes. It is possible to achieve a high travelling performance with a simple structure.

The aforementioned travelling apparatus further includes the first wheels; the second wheels configured to be disposed in a rear of the first wheels; the third wheels configured to be disposed in a rear of the second wheels; and the driving mechanism configured to raise and lower the first wheels. Then at least one of the second and third wheels are wheels having the dilatant fluid included therein. When at least one of the second and third wheels comes into contact with the corner part of the step, the wheels are deformed to a shape in accordance with the corner part. It is thus possible for the travelling apparatus to be adapted to steps of various shapes.

Note that the present disclosure is not limited to the above embodiments, and modifications can be made as appropriate without departing from the scope of the disclosure.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A travelling apparatus comprising:

a vehicle body;

a first wheel configured to be disposed in a front of the vehicle body;

a first link configured to be extendable and retractable and coupled between the first wheel and an oscillation axis located in a rear of the first wheel;

a first linear motion mechanism that is coupled between the vehicle body and the first link and is extended and retracted so as to rotate the first link about the oscillation axis;

a first brake configured to restrict rotation of the first link about the oscillation axis;

a second brake configured to restrict extension and retraction of the first link;

a second wheel configured to be disposed in a rear of the first wheel;

a driving mechanism configured to raise and lower the second wheel;

a third wheel configured to be disposed in a rear of the second wheel; and a second link configured to couple together the second wheel and the third wheel;

wherein the driving mechanism is a second linear motion mechanism that is coupled between the second link and the vehicle body and rotates the second link; and wherein a dilatant fluid is included in at least one of the second and third wheels.

2. The travelling apparatus according to claim 1, wherein at least two of the first to third wheels are driving wheels.

3. The travelling apparatus according to claim 1, wherein the first wheel, the second wheel, the third wheel, the first linear motion mechanism, and the second linear motion mechanism are arranged on right and left sides of the travelling apparatus and are driven independently on the right and left sides of the travelling apparatus.

4. The travelling apparatus according to claim 1, further comprising a wheel brake configured to restrict rotation of the first wheel.

5. A travelling apparatus comprising:

a vehicle body;

a first wheel configured to be disposed in a front of the vehicle body;

a first link configured to be extendable and retractable and coupled between the first wheel and an oscillation axis located in a rear of the first wheel;

a first linear motion mechanism that is coupled between the vehicle body and the first link and is extended and retracted so as to rotate the first link about the oscillation axis;

a first brake configured to restrict rotation of the first link about the oscillation axis;

a second brake configured to restrict extension and retraction of the first link;

a second wheel configured to be disposed in a rear of the first wheel;

a driving mechanism configured to raise and lower the second wheel;

a third wheel configured to be disposed in a rear of the second wheel;

a second link configured to couple together the second wheel and the third wheel;

an in-wheel motor provided in one of the second and third wheels; and a transmission mechanism configured to transmit a driving force of the in-wheel motor to the other one of the second and third wheels;

wherein the driving mechanism is a second linear motion mechanism that is coupled between the second link and the vehicle body and rotates the second link; and wherein at least two of the first to third wheels are driving wheels.

6. A travelling apparatus capable of climbing up and going down a step, the travelling apparatus comprising:

a vehicle body;

a wheel having a dilatant fluid included therein;

a first wheel;

a second wheel configured to be disposed in a rear of the first wheel;

a third wheel configured to be disposed in a rear of the second wheel; and a driving mechanism configured to move the first wheel upward or downward;

wherein at least one of the second wheel and the third wheel is a wheel having the dilatant fluid included therein.

* * * * *